US012709886B2

(12) United States Patent
Meyers

(10) Patent No.: US 12,709,886 B2
(45) Date of Patent: Aug. 18, 2026

(54) DRAIN SYSTEM FOR USE WITH A TILE FLOOR

(71) Applicant: EBBE AMERICA, LC, Clearfield, UT (US)

(72) Inventor: Lawrence G. Meyers, Clearfield, UT (US)

(73) Assignee: EBBE AMERICA, LC, Clearfield, UT (US)

( * ) Notice: Subject to any disclaimer, the term of this patent is extended or adjusted under 35 U.S.C. 154(b) by 6 days.

(21) Appl. No.: 18/919,063

(22) Filed: Oct. 17, 2024

(65) Prior Publication Data

US 2025/0052051 A1 Feb. 13, 2025

Related U.S. Application Data

(63) Continuation-in-part of application No. 18/797,178, filed on Aug. 7, 2024, now abandoned.

(60) Provisional application No. 63/531,746, filed on Aug. 9, 2023.

(51) Int. Cl.
*E03F 5/04* (2006.01)

(52) U.S. Cl.
CPC ..... *E03F 5/0407* (2013.01); *E03F 5/0408* (2013.01); *E03F 2005/0415* (2013.01)

(58) Field of Classification Search
CPC ..... E03F 5/0407; E03F 5/0408; E03F 2005/0415
See application file for complete search history.

(56) References Cited

U.S. PATENT DOCUMENTS

| | | | |
|---|---|---|---|
| 855,017 | A | 5/1907 | O'Brien |
| 889,051 | A | 5/1908 | Schodde |
| 1,127,246 | A | 2/1915 | Hirshstein |
| 1,143,174 | A | 6/1915 | Comstock |

(Continued)

FOREIGN PATENT DOCUMENTS

| | | | |
|---|---|---|---|
| FR | 2979577 | A1 | 3/2013 |
| KR | 10-1896456 | B1 | 9/2018 |

OTHER PUBLICATIONS

International Preliminary Report on Patentability received for PCT Patent Application No. PCT/US2008/056731, mailed on Sep. 15, 2009, 6 pages.

(Continued)

*Primary Examiner* — Kelsey E Cary
(74) *Attorney, Agent, or Firm* — Workman Nydegger

(57) ABSTRACT

A drain system comprises a frame configured for placement over a drain opening of a drain body. The frame has a wall portion and is movable over the drain opening for at least lateral adjustment relative to the drain opening during installation. A tray is removably positionable on the frame. The tray includes a wall portion and a plurality of support members distributed and spaced around an underside of the tray. The plurality of support members extend downwardly from the underside of the tray. The plurality of support members can be configured to interface with at least part of the frame such that a plurality of fluid paths are defined between the tray and frame when the tray is positioned on the frame. At least some of the plurality of fluid paths can extend around and under the tray and are in fluid communication with the drain opening.

15 Claims, 22 Drawing Sheets

(56) References Cited

U.S. PATENT DOCUMENTS

| | | | | |
|---|---|---|---|---|
| 1,189,742 | A | 7/1916 | Sanders | |
| 1,469,303 | A | 10/1923 | Arthur et al. | |
| 1,669,586 | A | 5/1928 | Boosey | |
| 1,749,878 | A | 3/1930 | Fleming | |
| 1,766,621 | A | 6/1930 | Fleming | |
| 1,792,345 | A | 2/1931 | Williams | |
| 1,830,065 | A | 11/1931 | Luff | |
| 2,095,024 | A | 10/1937 | Boosey | |
| 2,281,448 | A | 4/1942 | Mathey | |
| 2,394,964 | A | 2/1946 | Dick | |
| 2,484,240 | A | 10/1949 | Morthland | |
| 2,519,843 | A | 8/1950 | Aaron | |
| 2,550,402 | A | 4/1951 | Boosey | |
| 2,777,532 | A | 1/1957 | Sisk | |
| 2,780,303 | A | 2/1957 | Morris | |
| 2,783,852 | A | 3/1957 | Sisk | |
| 2,843,209 | A | 7/1958 | Degen | |
| 2,859,452 | A | 11/1958 | Seewack | |
| 2,898,129 | A | 8/1959 | Sisk | |
| 2,981,333 | A | 4/1961 | Miller et al. | |
| 3,037,631 | A | 6/1962 | Drehmann | |
| 3,040,895 | A | 6/1962 | Sisk | |
| 3,075,203 | A | 1/1963 | Stafford | |
| 3,121,682 | A | 2/1964 | Alberico | |
| 3,246,582 | A | 4/1966 | Clare et al. | |
| 3,268,920 | A | 8/1966 | Beer | |
| 3,742,524 | A | 7/1973 | Ballentine | |
| 3,959,831 | A | 6/1976 | Hendricks | |
| 4,032,455 | A | 6/1977 | Kale | |
| 4,067,072 | A | 1/1978 | Izzi | |
| 4,146,939 | A | 4/1979 | Izzi | |
| 4,150,009 | A | 4/1979 | Milenius | |
| 4,199,827 | A | 4/1980 | Tuleja | |
| 4,307,476 | A | 12/1981 | Halstad | |
| 4,418,432 | A | 12/1983 | Vidal | |
| 4,423,527 | A | 1/1984 | Morris et al. | |
| RE31,561 | E | 4/1984 | Thompson | |
| 4,505,814 | A | 3/1985 | Marshall | |
| 4,694,513 | A | 9/1987 | Kiziah | |
| 4,739,524 | A | 4/1988 | Burd | |
| 4,845,914 | A | 7/1989 | Burd | |
| 4,910,811 | A | 3/1990 | Izzi, Sr. | |
| 4,943,100 | A | 7/1990 | Emberson | |
| 5,003,642 | A | 4/1991 | Robb et al. | |
| 5,022,430 | A | 6/1991 | Degooyer | |
| 5,117,862 | A | 6/1992 | Molligan | |
| 5,130,016 | A | 7/1992 | Gavin | |
| 5,137,314 | A | 8/1992 | Gunter | |
| 5,216,767 | A | 6/1993 | Elmore | |
| 5,293,724 | A | 3/1994 | Cornwall | |
| 5,299,836 | A | 4/1994 | Woods | |
| 5,372,715 | A | 12/1994 | Maggard et al. | |
| 5,511,904 | A | 4/1996 | Van Egmond | |
| 5,656,176 | A | 8/1997 | Scott | |
| D421,295 | S | 2/2000 | Barnett | |
| 6,088,842 | A | 7/2000 | Barnett | |
| 6,173,455 | B1 | 1/2001 | Nordstrom | |
| 6,175,971 | B1 | 1/2001 | O'Neill | |
| 6,192,532 | B1 | 2/2001 | Sesser et al. | |
| 6,381,775 | B1 | 5/2002 | Sondrup | |
| 6,553,583 | B1 | 4/2003 | Pan | |
| 6,877,471 | B1 | 4/2005 | Tanabe et al. | |
| 6,890,427 | B2 | 5/2005 | Self et al. | |
| 7,178,179 | B2 | 2/2007 | Barnes | |
| 7,178,675 | B2 | 2/2007 | Votel | |
| 7,442,296 | B2 | 10/2008 | Chong et al. | |
| 7,472,719 | B2 | 1/2009 | Dallmer | |
| 7,632,401 | B2 | 12/2009 | Edelmayer | |
| 7,699,981 | B2 | 4/2010 | Ledford et al. | |
| 7,725,960 | B2 | 6/2010 | Markaj | |
| 7,739,757 | B2 * | 6/2010 | Witt | E03F 5/0408 4/612 |
| 8,043,497 | B2 | 10/2011 | Silverstein et al. | |
| 8,060,956 | B2 | 11/2011 | Degooyer | |
| 8,146,616 | B2 | 4/2012 | Dallmer | |
| 8,191,330 | B1 | 6/2012 | Cornwall | |
| 8,833,387 | B2 | 9/2014 | Lucas et al. | |
| 9,175,464 | B2 | 11/2015 | Meyers | |
| 9,453,331 | B1 | 9/2016 | Buffington | |
| 9,567,738 | B2 | 2/2017 | Schlueter | |
| 9,731,441 | B2 | 8/2017 | Dejesus et al. | |
| 9,848,742 | B2 | 12/2017 | Phillips | |
| 2003/0159978 | A1 | 8/2003 | Self et al. | |
| 2005/0223481 | A1 | 10/2005 | Giacomi | |
| 2007/0000038 | A1 | 1/2007 | Jordon et al. | |
| 2007/0209109 | A1 | 9/2007 | Meyers | |
| 2008/0005835 | A1 | 1/2008 | Shipley et al. | |
| 2008/0106094 | A1 | 5/2008 | Edelmayer | |
| 2008/0189926 | A1 | 8/2008 | Luxton | |
| 2008/0216221 | A1 | 9/2008 | Markaj | |
| 2008/0271232 | A1 | 11/2008 | Self | |
| 2008/0277324 | A1 | 11/2008 | Meyers | |
| 2010/0043136 | A1 | 2/2010 | Michael | |
| 2010/0235982 | A1 | 9/2010 | Stimpson et al. | |
| 2010/0288685 | A1 | 11/2010 | Meyers | |
| 2010/0320130 | A1 | 12/2010 | Meyers | |
| 2012/0036629 | A1 * | 2/2012 | Cook | E03F 5/0407 4/613 |
| 2012/0047643 | A1 | 3/2012 | Meyers | |
| 2012/0240319 | A1 | 9/2012 | Yssel | |
| 2013/0318705 | A1 * | 12/2013 | Plank | E03F 5/0408 29/428 |
| 2014/0130902 | A1 | 5/2014 | Lucas et al. | |
| 2014/0263002 | A1 * | 9/2014 | Antoniello | E03F 5/041 210/163 |
| 2015/0101120 | A1 * | 4/2015 | McLeod | E03F 5/0408 4/613 |
| 2015/0275497 | A1 | 10/2015 | Nyce | |
| 2016/0281346 | A1 | 9/2016 | Clear et al. | |
| 2017/0058504 | A1 | 3/2017 | Wilkie | |
| 2017/0138036 | A1 | 5/2017 | Priester | |
| 2019/0242107 | A1 | 8/2019 | Mcleod | |
| 2019/0316341 | A1 * | 10/2019 | Say | E03F 5/0407 |
| 2019/0316554 | A1 | 10/2019 | Berg et al. | |
| 2020/0157790 | A1 | 5/2020 | English | |
| 2020/0173160 | A1 * | 6/2020 | Meyers | E03F 5/041 |
| 2023/0257996 | A1 * | 8/2023 | Leslie | E04D 13/1693 52/506.05 |

OTHER PUBLICATIONS

International Preliminary Report on Patentability received for PCT Patent Application No. PCT/US2019/061084, mailed on Jun. 17, 2021, 9 pages.

International Search Report and Written Opinion received for PCT Patent Application No. PCT/US19/061084, mailed on Jan. 29, 2020, 2 pages.

International Search Report and Written Opinion received for PCT Patent Application No. PCT/US2008/056731, mailed on Jul. 17, 2008, 8 pages.

Schluter(Registered)—KERDI-DRAIN-AR; http://www.schulter.com/schluter-us/en_US/Shower-System/Drains/Schluter(Registered)-KERDI-DRAIN-AR/p/KERDI_DRAIN-AR Retrieved on Dec. 19, 2016.

U.S. Appl. No. 11/716,851, filed Apr. 7, 2009, Office Action.

U.S. Appl. No. 11/716,851, filed Oct. 27, 2009, Final Office Action.

U.S. Appl. No. 12/046,352, filed Apr. 6, 2009, Office Action.

U.S. Appl. No. 12/046,352, filed Nov. 2, 2009, Final Office Action.

U.S. Appl. No. 12/862,681, filed Dec. 6, 2012, Office Action.

U.S. Appl. No. 12/862,681, filed Jul. 23, 2013, Office Action.

U.S. Appl. No. 12/862,681, filed Sep. 18, 2013, Final Office Action.

U.S. Appl. No. 12/862,689, filed Aug. 14, 2013, Final Office Action.

U.S. Appl. No. 12/862,689, filed Dec. 16, 2014, Office Action.

U.S. Appl. No. 12/862,689, filed Dec. 4, 2013, Office Action.

U.S. Appl. No. 12/862,689, filed Jan. 15, 2013, Office Action.

U.S. Appl. No. 12/862,689, filed Jul. 29, 2014, Final Office Action.

Brochure—Schluter@-KERDI-DRAIN-AR; Dec. 19, 2016, 4 pages; Retrieved from the internet on Nov. 8, 2019 from web.archive.org/web/20161219214055/http://www.schulter.com/schluter-us/en_us/

(56) References Cited

OTHER PUBLICATIONS

Shower-System/Drains/Sehluter®-KERDI-DRAIN-AR/p/KERDI_DRAIN-AR.

* cited by examiner

DRAIN SYSTEM FOR USE WITH A TILE FLOOR

TECHNICAL FIELD

The disclosure relates to a drain system for improved installation in tile floor or other wet floor area.

BACKGROUND

Tile flooring is frequently used in bathrooms, showers, laundry rooms, kitchens, and/or other rooms or areas. Many tiled floors include a drain that provides an exit path for water that falls onto the tiled floor. In showers, a drain is typically placed in or near the center of the shower floor, and the shower floor is sloped slightly towards the drain to ensure that water runs toward the drain as opposed to remaining on the floor or seeping into the structure of or proximate to the shower. Shower drains in tiled showers seldom have a shape that exactly matches the shape of the tile used on the surrounding shower floor. Cutting and laying tile that conforms to the shape of conventional shower drains is thus associated with many challenges. Moreover, tiling a floor can be even more challenging when the tiles approaching the drain are irregularly shaped, requiring excessive cutting or shifting of the tiles to achieve a desirable aesthetic. Even when tiles approaching a drain are cut and/or placed well, conventional shower drains are constructed from materials with different visual and material characteristics than tile, which can make it difficult to achieve a uniform and/or visually appealing aesthetic in tile floors. Such challenges can arise when installing a new tiled floor with a drain or when replacing an existing drain within a tiled floor, which can often involve height adjustments, tile matching, and/or other processes.

Laying tiles in a manner that avoids common separation or slight openings in grout joints between the drain and surrounding tiles can also be challenging. The occurrence of separation and/or slight openings in grout joints can lead to excessive passage of water between the drain and the surrounding tiles that can damage and/or otherwise compromise the structural integrity of the floor. In the case of replacing or retrofitting drain systems, it can be costly and/or time-consuming to match drain covers to the precise shape of openings formed in the tiles for the drain.

Accordingly, there is a need for a drain system that incorporates certain design improvements over other systems for a tile-in drain system.

SUMMARY

Embodiments of the present disclosure can advantageously provide drain systems that incorporate certain design improvements over conventional tile-in drain systems. According to an embodiment, a drain system includes a frame configured for placement over a drain opening of a drain body. A tray is removably positionable on the frame. The tray can include a plurality of support members distributed and spaced around an underside of the tray. The plurality of support members are configured to interface with at least part of the frame such that a plurality of fluid paths are defined between the tray and the frame when the tray is positioned on the frame. At least some of the plurality of fluid paths can extend around and under the tray and are in fluid communication with the drain opening, allowing for the efficient and discreet flow of fluid from a wet floor area into the drain system.

According to an embodiment, the tray can carry flooring materials and the plurality of fluid paths includes a peripheral inlet defined around the periphery of the tray and below the underside of the tray. The drain system help create more visually appealing aesthetics in tile floors. For instance, the drain system can be more advantageously integrated within a wet floor area because the peripheral inlet is subtly positioned around and within the flooring materials, and other components of the drain system are substantially hidden below wet floor area.

According to a variation, an area and/or volume of the plurality of the fluid paths may substantially correspond to or exceed an area and/or volume of the drain opening of the drain body, thereby helping to ensure proper drainage through the drain system.

BRIEF DESCRIPTION OF THE DRAWINGS

These and other features, aspects, and advantages of the present disclosure will become better understood regarding the following description, appended claims, and accompanying drawings.

Figure 1:
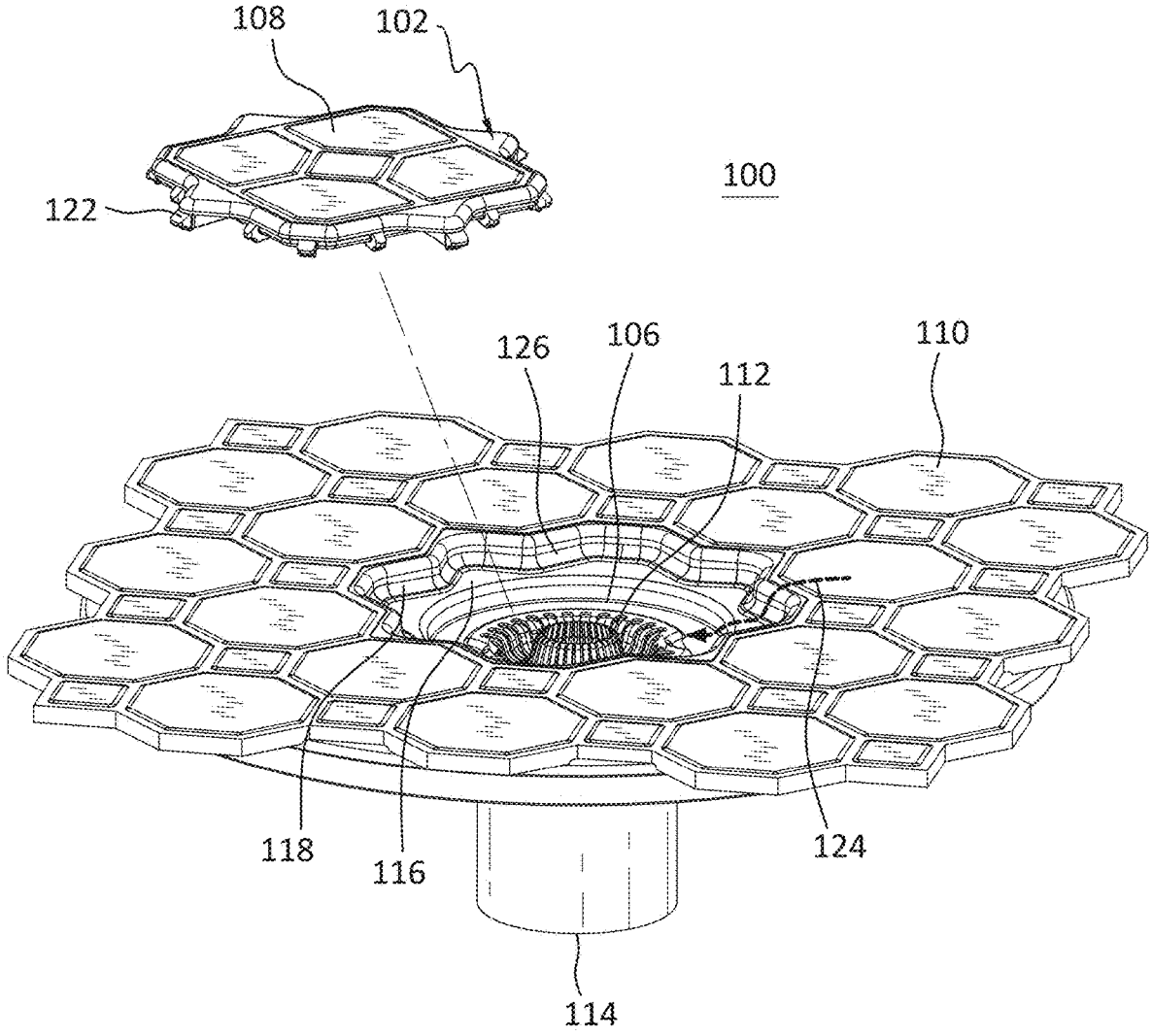
FIG. 1 shows a top perspective view of a drain system according to an embodiment.

The drawing figures are not necessarily drawn to scale, but instead are drawn to provide a better understanding of the components, and are not intended to be limiting in scope, but to provide example illustrations. The figures illustrate example configurations of drain systems, and in no way limit the structures or configurations of a drain system and components according to the present disclosure.

DETAILED DESCRIPTION OF VARIOUS EMBODIMENTS

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the intention covers all modifications, alternative constructions, combinations, and equivalents falling within the spirit and scope of the disclosure.

It will be understood that unless a term is expressly defined in this application to possess a described meaning, there is no intent to limit the meaning of such term, either expressly or indirectly, beyond its plain or ordinary meaning.

Embodiments of the present disclosure can advantageously provide drain systems that incorporate certain design improvements over conventional tile-in drain systems. By way of overview, at least some disclosed drain systems include a frame that can be placed over a drain body directly in a mortar bed. The frame can have a shape (e.g., a polygonal shape) that conforms to the shape/arrangement of the tiles of the tile floor in which the frame is placed (or will be placed). The frame can thus improve the ease of laying tile adjacent to and approaching the drain system.

The frame may include an outer sidewall and a base portion extending inward from the outer sidewall. The base portion (or lip) may define a resting position for a tray that can be placed in the frame. The tray can be removably positioned on the frame. The tray may include a set of support members distributed about a bottom or underside of the tray and configured to interface with the base member. The support members may comprise body members that offset a main body of the tray a distance from the frame when the tray is placed on the frame. The support members may additionally be spaced apart from one another on the bottom of the tray so as to define a plurality of fluid paths between the support members, the frame, and the tray when the tray is placed on the frame. The plurality of fluid paths may facilitate peripheral passage of fluid from above the drain system into the drain body or drain structure below the frame. In an embodiment, the total area and/or volume of the fluid paths may substantially correspond to or exceed the area and/or volume of the drain opening of the drain body, thereby helping to ensure proper drainage of the tile floor.

The tray may include a recess extending over a top portion thereof that can be configured to receive mortar and tiles, which can be selected to visually conform to the tile design of the tile floor in which the drain system is installed (or to be installed). Disclosed drain systems may thus facilitate fluid draining functionality while maintaining a tiled aesthetic and without visually exposing the drain body, which can contribute to the overall aesthetic of the shower (or other space) in which the drain system is installed.

The disclosed drain system embodiments can be used in a wide variety of contexts, including retrofits, replacements, and new installations. Although at least some examples and/or descriptions used herein may focus, in at least some respects, on implementation of a drain system in a shower, the disclosed drain systems may be utilized in other contexts (e.g., bathroom floors, laundry room floors, locker rooms floors, kitchen floors, furnace/utility rooms, entry/mud rooms, deck floors, dining rooms, sinks, and/or other spaces).

Figure 2:
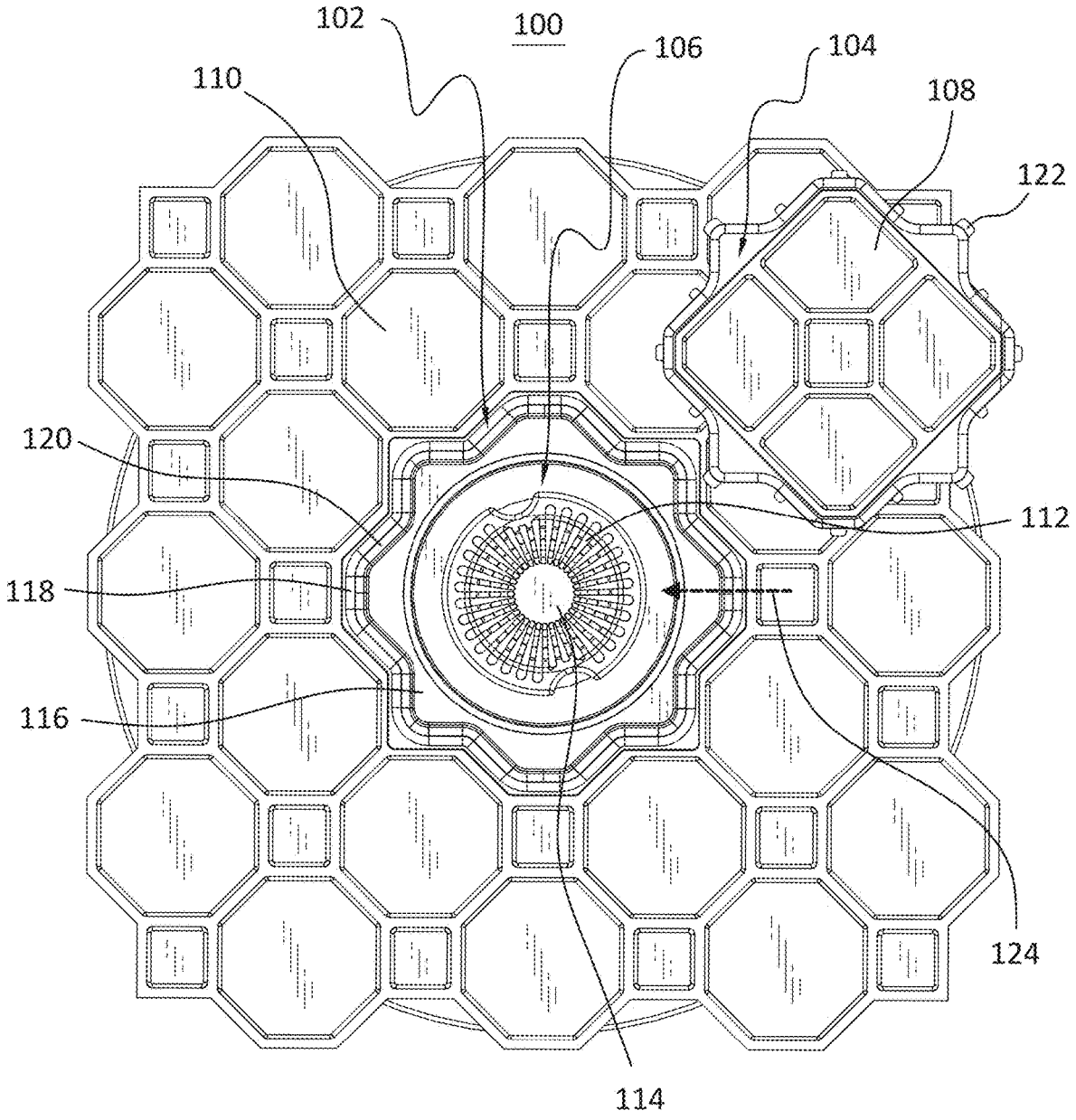
FIG. 2 is a top view of the drain system of FIG. 1.
Figure 3:
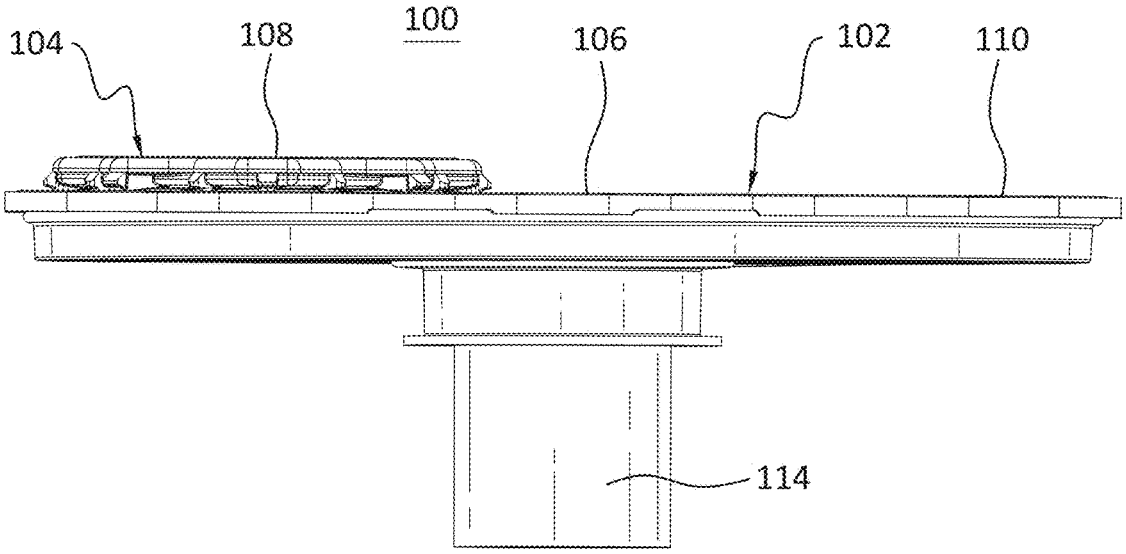
FIG. 3 is a side view of the drain system of FIG. 1.

FIGS. 1, 2, and 3 illustrate different perspectives of a drain system 100 according to an embodiment including a frame 102 and a tray 104. The tray 104 can be removably positioned on the frame 102. The frame 102 is configured to support and position the tray 104 over a drain body 106 defining a drain opening 114 installed within one or more tiles 108 of a tile floor 110.

In the illustrated embodiment, a drain system 100 can include a debris trap 112 defining openings that allow water to drain through the debris trap 112 into a drain opening 114 of the drain body 106 below. One will appreciate that the particular shapes of the body of the drain body 106, the drain opening 114, and the debris trap 112 as shown in FIGS. 1, 2, and 3 are provided by way of example only and are not limiting of the principles described herein.

For instance, the drain body 106 can comprise a round tile-in shower drain, an existing drain body in a tile floor, a square, round, or any other shape of drain riser, or any other suitable drainage component over which the frame 102 can be positioned as described below. The drain body 106 can be made of metal, plastic, ceramic, combinations thereof, or any other suitable material.

As shown in FIGS. 1 and 2, the frame 102 can include a base portion 116 and a wall portion 118 projecting upwardly from the base portion 116. The base portion 116 extends radially inward from a lower end of the wall portion 118 towards the center of the drain opening 114 when positioned thereover. The base portion 116 defines an opening 120 positionable about the drain opening 114 of the drain body 106. The base portion 116 may also be referred to as a lip. The frame 102 can be formed of a metal material such as aluminum or steel, or of a rigid polymeric or ceramic or other material. In other embodiments, the frame 102 can be flexible or semiflexible to provide some tolerance in a fit between the tray 104 and/or the tile floor 110.

Figure 2A:
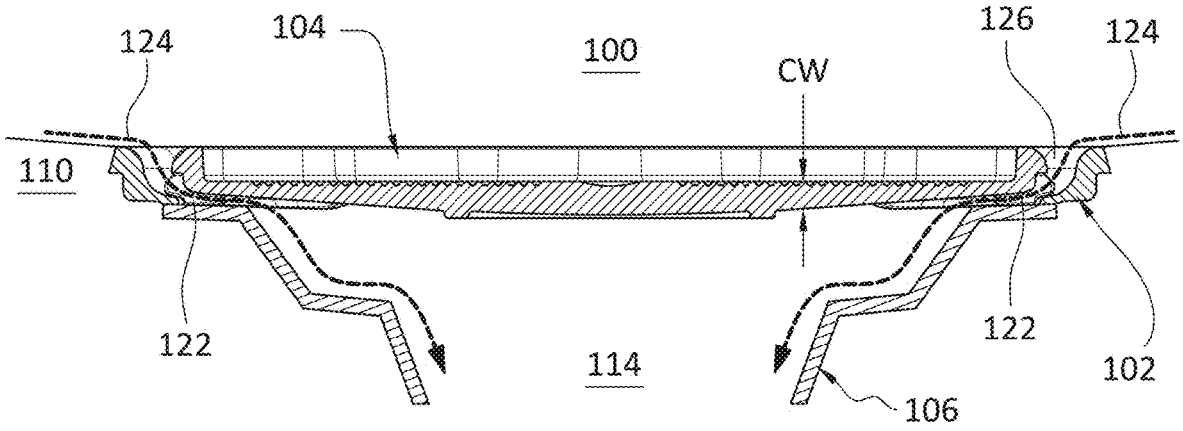
FIG. 2A is a schematic cross-section side view of the frame and tray of FIG. 1.

The tray 104 may include a plurality of support members 122 distributed about a bottom or underside of the tray 104 and configured to interface with the base portion 116 of the frame 102 as schematically shown in FIG. 2A. One or more of the plurality of support members 122 may comprise a body member configured to support the tray 104 on the frame 102 and to offset a main body of the tray 104 from the frame 102 when the tray 104 is positioned on the frame 102. As shown, the support members 122 can extend downwardly and radially outwardly from the bottom of the tray 104. In other embodiments, the support members 122 may extend downwardly from the bottom of the tray 104. In other embodiments, the body member can comprise a post or block member. In yet other embodiments, the support members 122 may be included on the frame 102 and/or the frame 102 and the tray 104.

According to one embodiment of the present disclosure, the support members 122 may be positioned and sized to define one or more fluid paths 124 between the tile floor 110 and the drain opening 114 below the frame 102. In an embodiment, the one or more fluid paths 124 can include a peripheral inlet 126 extending around the tray 104 between the frame 102 and the tray 104 when the tray 104 is positioned on the frame 102. The one or more fluid paths 124 may extend between the support members 122 and between the underside of the tray 104 and the frame 102 when the tray 104 is placed on the frame 102, allowing for the efficient and discreet flow of fluid from the tile floor 110 into the drain body 106. For example, the one or more fluid paths 124 may facilitate the discreet flow or passage of fluid from the tile floor 110 or above the drain system 100 through the peripheral inlet 126 between the frame 102 and the tray 104 into the drain opening 114 of the drain body 106. The drain system 100 can thus help create more visually appealing aesthetics in tile floors. For instance, the drain system 100 can be advantageously integrated within the tile floor 110 because the peripheral inlet 126 is subtly positioned around and within the tiles 108 and other portions of the drain system 100 are substantially hidden below the tile floor 110. It will be appreciated that while the drain system is shown and described in a tile floor 110. In other embodiments, the drain system can be configured for use with other wet floor areas. For instance, drain systems of the present disclosure can be arranged for use in concrete, stone, polymer, composite, earthen, and any other suitable wet floor areas.

Optionally, the total area and/or volume of the one or more fluid paths 124 and/or the peripheral inlet 126 may substantially correspond to an area and/or volume of the drain opening 114 and/or entry path of the drain body 106. For instance, the peripheral inlet 126 can have an area substantially corresponding to or exceeding an area of the drain opening 114. This advantageously can help the drain system 100 handle a desired fluid flow from the tile floor 110 without causing excessive pressure drops or flow restrictions during use of the drain system 100.

In an embodiment, the tray 104 can have a varying cross-sectional shape. For instance, the tray 104 can have a cross-section thickness CW that increases from an outer portion of the tray 104 toward a center portion of the tray 104 such that the cross-section thickness CW of the tray 104 is thinner toward the center portion of the tray 104. This can increase a volume and/or area of the one of more fluid paths 124 between the tray 104 and the frame 102 toward the outer portion of the tray 104. The one or more fluid paths 124 can be in fluid communication with the tile floor 110 and the drain opening 114. This advantageously helps to improve flow or drainage into the drain system 100 and to direct fluid from the tile floor 110 toward the drain opening 114.

The tray 104 can be removably positioned on the frame 102. For instance, the tray 104 can be removed from the drain system 100 or lifted off the frame 102 to access or clean the drain opening 114 of the drain body 106. FIG. 2 shows the tray 104 being disconnected from and arranged above and laterally offset from the drain body 106. The tray 104 is shown configured to carry one or more tiles 108 of the tile floor 110, allowing the tray 104 to form part of the tile floor 110. This advantageously improves the aesthetics of the tile floor 110 by better incorporating the drain system 100 with the tile floor 110. In the illustrated embodiment, the tray 104 defines a substantially polygonal shape suited to communicate with a similarly shaped frame 102. In the illustrated embodiment, the tray 104 has the shape of an 8-sided polygon (e.g., a substantially octagonal shape). The shape and size of the frame 102 can vary according to the shape and size of the tray 104 and/or tiles adjacent to the frame 102 on the tile floor 110. For instance, the frame 102 can comprise a molded plastic member including defining a substantially polygonal shape arranged to mate or fit within a substantially polygonal opening defined by a tile floor 110 surrounding the frame 102.

In other embodiments, the frame 102 can comprise a molded plastic member including a periphery having a honeycomb shape arranged to mate or fit within a honeycomb-shaped opening defined by a plurality of hexagonal tiles surrounding the frame 102. In other embodiments, the frame 102 can substantially follow the shape of a triangle, a rectangle, a diamond, an irregular or curved shape, combinations thereof, or others. Likewise, the periphery of the frame 102 can substantially correspond to the shape of the tray 104. The versatility of the frame 102 can thus beneficially allow the drain system 100 to work with many different tile shapes, tray shapes, and frame shapes.

Figure 4:
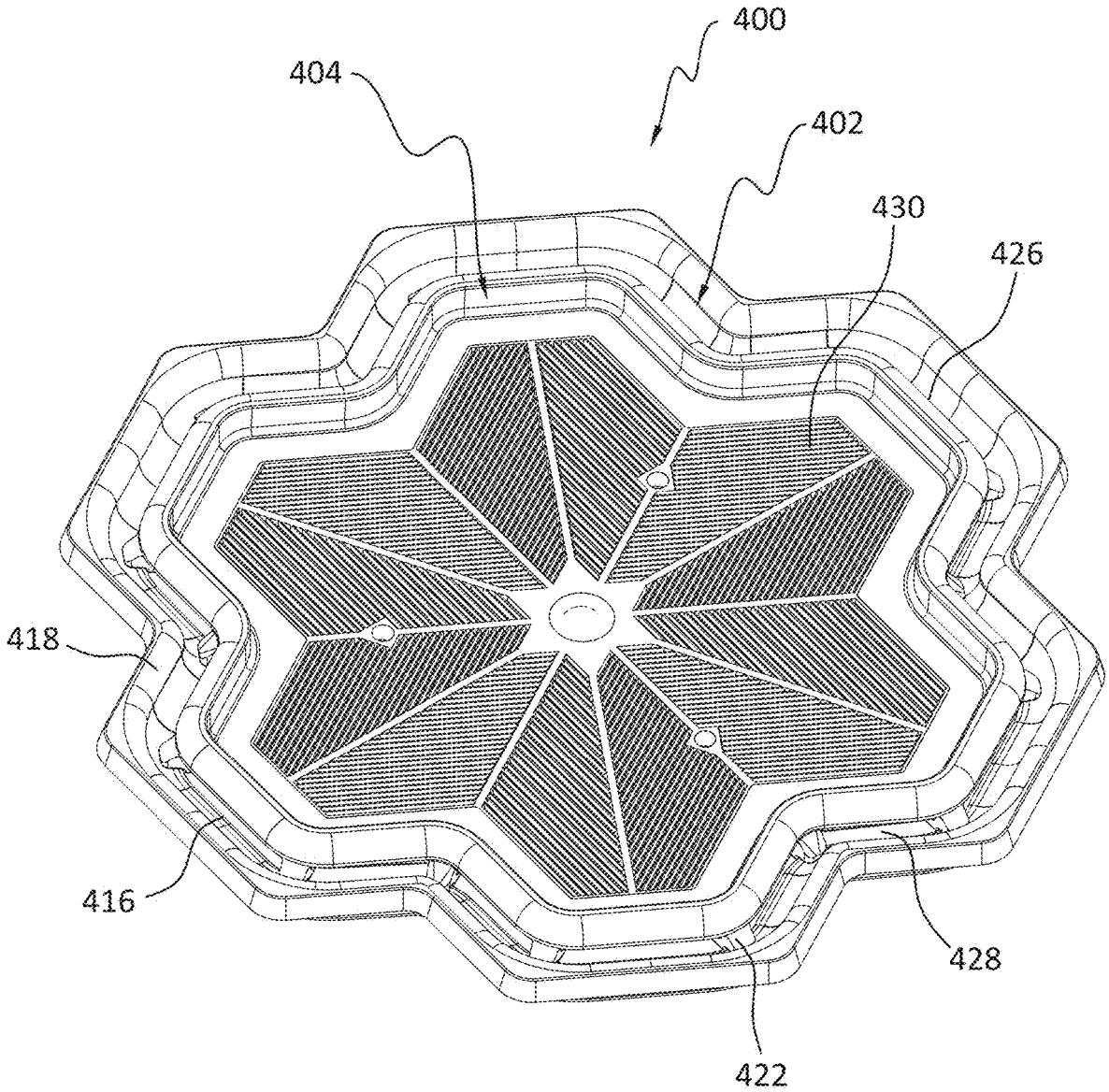
FIG. 4 is a top perspective view of a frame and tray of a drain system according to an embodiment.
Figure 5:
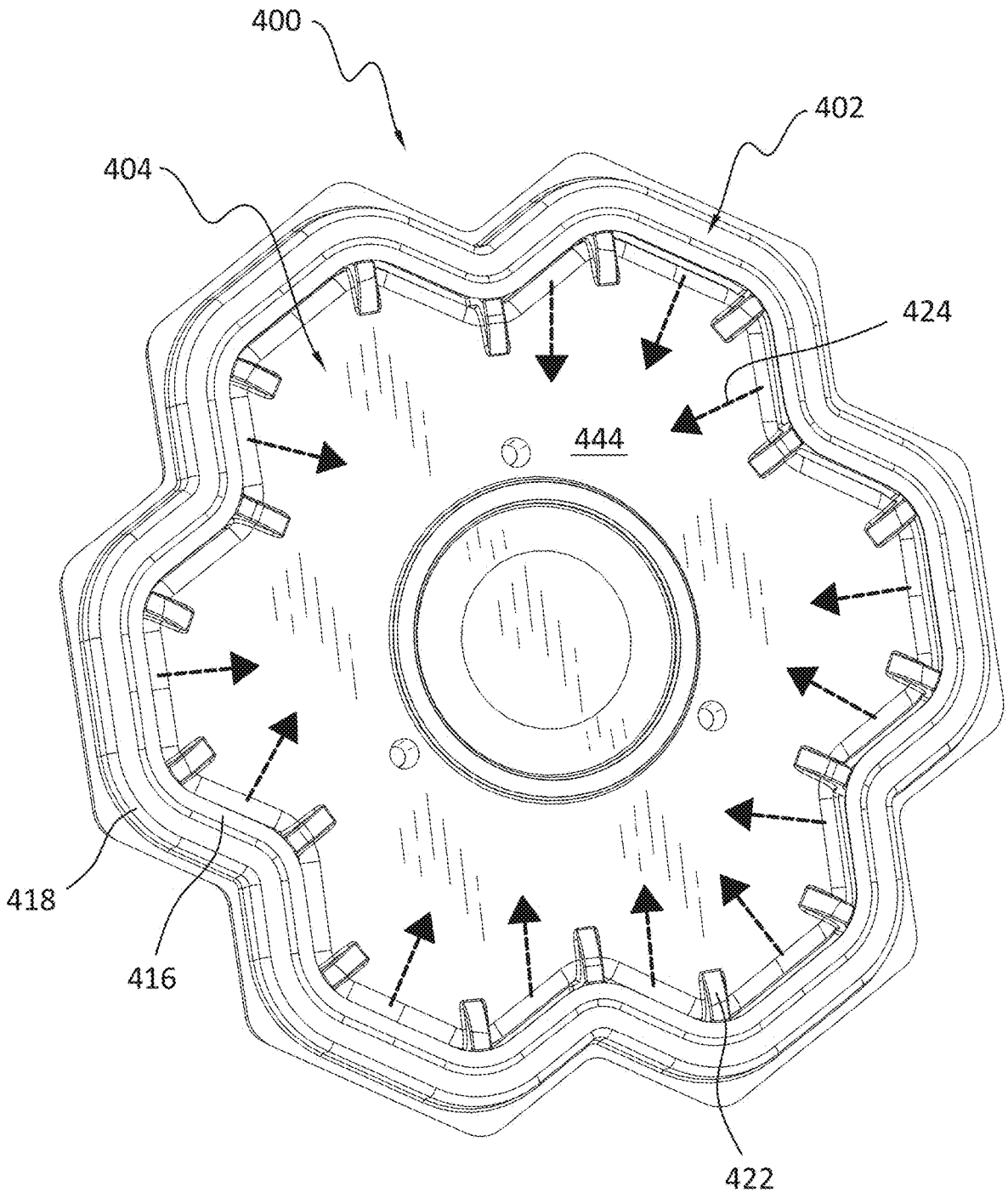
FIG. 5 is a bottom perspective view of the frame and tray of FIG. 4 according to an embodiment.

FIGS. 4 and 5 show top and bottom perspective views, respectively, of another example embodiment of a drain system 400 including a frame 402 and a tray 404. FIGS. 4 and 5 show the frame 402 and the tray 404 that have similar properties as the frame 102 and tray 104 of the illustrated embodiment of FIGS. 1-3.

The tray 404 can be removably positioned on the frame 402. As shown in FIGS. 4, 5, and 6, the frame 402 can be positioned at least partially below the tray 404 and defines a seat or support surface for the tray 404. More particularly, the frame 402 may define a base portion 416 or lip on which the tray 404 may be supported above a drain body (see, for example, drain body 106 of FIG. 1). The tray 404 can be removably positioned on the frame 402.

Like in other embodiments, the tray 404 may include a plurality of support members 422 distributed about a bottom or underside of the tray 404 and configured to interface with the base portion 416 of the frame 402. The support members 422 may be positioned and sized to define one or more fluid paths 424 between or in fluid communication with a tile floor and a drain opening below the frame 402. In an embodiment, the one or more fluid paths 424 can include a peripheral inlet 426 extending around the tray 404 between the frame 402 and the tray 404 when the tray 404 is positioned on the frame 402. The one or more fluid paths 424 may extend between and around the support members 422 and between the underside of the tray 404 and the frame 402 when the tray 404 is placed on the frame 402, facilitating draining of fluid from the tile floor through the drain system 400 and substantially concealing the drain system 400 in the tile floor. This beneficially helps create more visually appealing aesthetics in the tile floor. For instance, the drain system 400 can be advantageously integrated within the tile floor because the peripheral inlet 426 can be subtly positioned around and within the tiles and other portions of the drain system 400 are substantially hidden below the tile floor.

In an embodiment, the one or more fluid paths 424 comprise at least one passageway 428 extending between one or more or each support of the plurality of support members 422 and between a bottom of the tray 404 and the frame 402. By way of example, water may flow through the at least one passageway 428 between one or more of the plurality of support members 422 toward a drain opening of a drain body, allowing for drainage of water (and/or other fluids) from a tile floor through the drain system 400 between the frame 402 and the tray 404. The frame 402 can thus retain and support the tray 404 within a tile floor (see, for example, 135 of FIG. 1) while allowing the drainage of water between the frame 402 and the tray 404. The drain system 400 can thus create an illusion that the water is draining through tiles in the tile floor when the tray 404 is carrying one or more tiles and positioned on the frame 402.

Optionally, the total area and/or volume of the one or more fluid paths 424 and/or the peripheral inlet 426 may substantially correspond to an area and/or volume of the drain opening and/or entry path of the drain body. In an embodiment, the peripheral inlet 126 can have an area substantially corresponding to or exceeding an area of the drain opening. In an embodiment, the peripheral inlet 126 can have an area that is at least as great as an area of the drain opening. This advantageously can help the drain system 400 handle a desired fluid flow without causing excessive pressure drops or flow restrictions during use of the drain system 400.

As discussed above, the frame 402 may be configured for placement over a drain opening (see, for example, drain opening 114 of FIG. 1) of a drain body (see, for example, drain body 106 of FIG. 1). The frame 402 may also be configured to receive and support the tray 404 by defining a place on which the tray 404 may be positioned. The frame 402 may also receive and support a tray 404 by defining an outer shape that is substantially similar to the outer shape of the tray 404. For example, the frame 402 and the tray 404 may have a substantially polygonal outer shape (which may implement fillets and/or curves over corners and/or edges). According to an embodiment, the plurality of support members 422 can in part restrict or limit lateral movement of the tray 404 relative to the frame 402 when the tray 404 is positioned in the frame 402. In some instances, the support members 422 are the only part of the tray 404 that directly interfaces with the frame 402. The frame 402 may also comprise a wall portion 418 of the frame 402 that may define an inner shape of the frame 402 that is similar to an outer shape of the tray 404.

The tray 404 may be configured to carry one or more tiles (see, for example, tile(s) 108 of FIG. 1). For example, the tray 404 may define a tray recess 430 configured to receive one or more tiles (see, for example, tile(s) 108 of FIG. 1). The tray recess 430 may include one or more grout retention features that allows the tray recess 430 to secure grout to support the one or more tiles. In an embodiment the one or more grout retention features can comprise a textured surface. In such a way, the frame 402 and tray 404 may at least partially blend into a surrounding tile floor and may mitigate jarring aesthetic differences between a tile floor and a drain system. This may maintain a more uniform appearance in the tile floor, increasing the aesthetic appeal of the tile floor.

According to an embodiment, the tray 404 may also include the plurality of support members 422 distributed around an underside of the tray 404. The plurality of support members 422 may be keyed to an inner shape of the frame 402 and may be configured to rest on a base portion 416 or lip defined on the frame 402. The plurality of support members 422 may thus both locate and support the tray 404 on the frame 402.

The plurality of support members 422 may also be distributed around the underside of the tray 404 in such a way as to define a plurality of fluid paths 424 between the frame 402 and the tray 404. The plurality of fluid paths 424 can define a peripheral inlet 426 between the tray 404 and the frame 402, allowing for the peripheral flow of fluids around the tray 404 toward a drain opening of a drain body below the frame 402 (See, for example, drain opening 114 of FIG. 1). In such a way, the plurality of support members 422 may allow the tray 404 to be located on the frame 402 while allowing the flow of water into a drain body.

In an embodiment, the plurality of support members 422 may be configured to interface with at least part of the frame 402 such that a plurality of fluid paths 424 are defined between the tray 404 and the frame 402 when the plurality of support members 422 interface with at least the part of the frame 402. For example, one or more fluid paths in the plurality of fluid paths 424 may be defined by an upper surface of the frame 402, an outer surface of the tray 404, and surfaces of adjacently arranged support members of the plurality of support members 422.

According to an embodiment, the plurality of fluid paths 424 between the frame 402 and the tray 404 may include a total area and a total volume. The total area of the plurality of fluid paths 424 2 may define a two-dimensional space occupying the space between a highest point on the wall portion 418 of the frame 402 and a point on the tray 404 adjacent to the highest point of the wall portion 418 of the frame 402. In other embodiments, the total volume of the plurality of fluid paths 424 may be defined by the three-dimensional space occupying the space between the tray 404 and the wall portion 418 of the frame 402 including the fluid paths 424 defined at least in part by the spaces between the plurality of support members 422 distributed around the underside of the tray 404. In an embodiment, this volume may correspond to a volume of a drain opening (see, for example, drain opening 114 of FIG. 1), which may improve the flow capacity of the drain system 400, contributing to an efficient flow rate of fluid through the plurality of fluid paths. In an embodiment, the spaces between the plurality of support members 422 can be uniform. In other embodiments, the spaces between the plurality of support members 422 can be nonuniform.

Figure 6A:
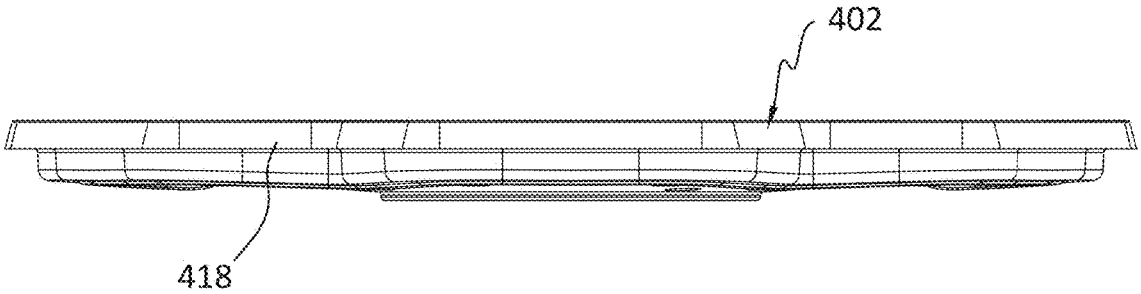
FIG. 6A is a side perspective view of the frame and tray of FIG. 4 according to an embodiment.
Figure 6B:
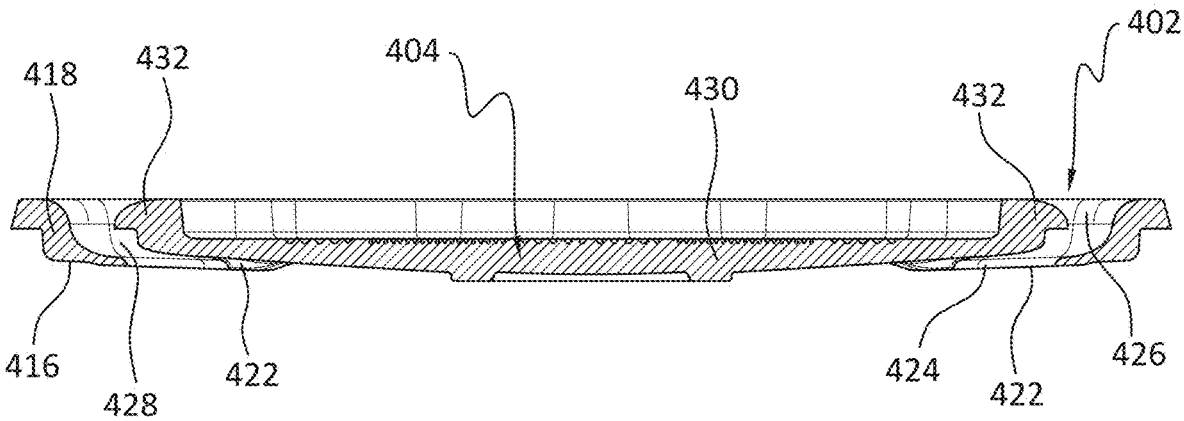
FIG. 6B is a cross-section side view of the frame and tray of FIG. 4 according to an embodiment.

FIGS. 6A and 6B show a side view and a cross-sectional side view, respectively, of an example embodiment including the frame 402 and the tray 404 according to an embodiment. FIG. 6B shows at least some of the plurality of fluid paths 424 as defined by support members of a plurality of support members 422. As shown in FIG. 6B, the plurality of fluid paths 424 may include the spaces between the support members of the plurality of support members 422. The support members 422 may thus be sized to define a gap between a rim of the frame 402 and the tray 404. The gap may form at least part of the peripheral inlet 426 between the tray 404 and the frame 402 for peripheral flow. For example, water or fluid may flow through an upper area defined between the wall portion 418 of the frame 402 and the tray 404 and a bottom area defined between the base portion 416 of the frame 402 and the tray 420. The gap may thus comprise a plurality of fluid paths 424. For example, water may flow through the plurality of fluid paths 424, thus allowing for drainage of water into a drain body such as the drain body of FIGS. 1, 2, and 3.

Both the tray 404 and the wall portion 418 of the frame 402 may be configured to improve flow characteristics into and out of the plurality of fluid paths 424 defined between the frame 402 and the tray 404. For example, the wall portion 418 of the frame 402 or an outer wall 432 of the tray 404 may comprise a curved surface that contributes toward improved flow characteristics into and through the plurality of fluid paths 424. According to an embodiment, the wall portion 418 of the frame 402 may be curved. According to an additional, alternative, or the same embodiment, the outer wall 432 of the tray 404 may be curved.

Support members of the plurality of support members 422 may also be configured to both support and define a final position for the tray 404 on the frame 402. For example, the support members may be distributed around an underside of the tray 404 evenly such that there is a substantially equal amount of space between each support. In an additional or alternative embodiment, the support members may be distributed around an underside of the tray 404 such that there is a different amount of space between each at least some of the support members.

FIG. 5 shows an example of the support members 422 being distributed evenly such that there is an equal amount of space between each support 422. As shown by FIG. 5, the support members 422 may be distributed at regular intervals around an underside 444 of the tray 404 such that there is an equal amount of space between each support 422. Further, the support members 422 extend a distance along the underside 444 of the tray 404 and protrude a distance radially outward from the underside 444. This advantageously helps form a clearance between the underside 444 of the tray 404 and the wall portion 418 of the frame 402, forming one or more fluid paths 424 between the frame 402 and the tray 404 to the draining opening.

Figure 7A:
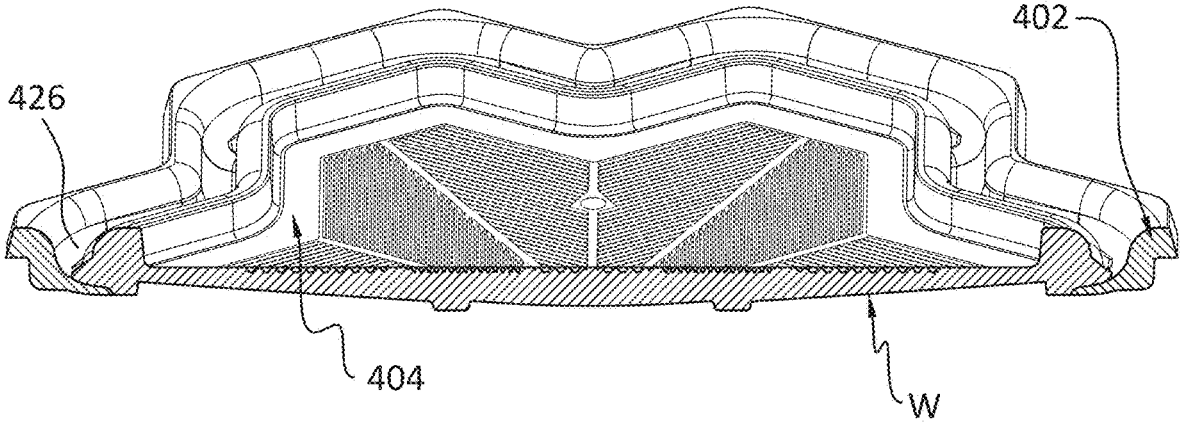
FIG. 7A is a cross-section view of the frame and tray of FIG. 4 from a top perspective according to an embodiment.
Figure 7B:
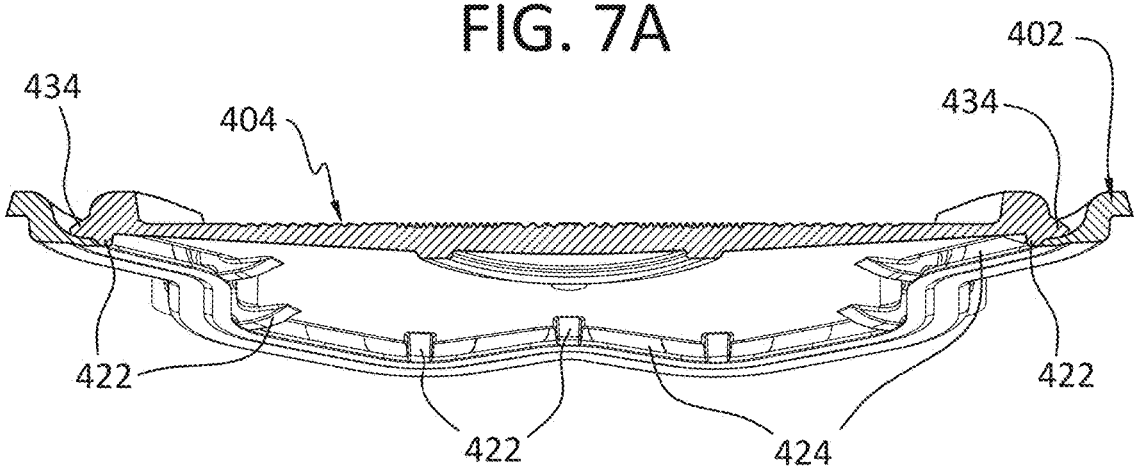
FIG. 7B is a cross-section view of the frame and tray of FIG. 4 from a bottom perspective according to an embodiment.

In some implementations, the plurality of support members 422 may have different shapes. FIGS. 7A and 7B show a cross-section view of the frame 402 and tray 404 from a top and bottom perspective, respectively, according to an embodiment. As shown in FIGS. 7A and 7B, the tray 404 can have a varying cross-sectional shape. For instance, the tray 404 can have a cross-sectional thickness W that increases from a radial outer portion of the tray 404 toward a radial center portion of the tray 404. As such, the cross-sectional thickness W of the tray 404 toward the radial outer portion tray is thinner, which, in turn, can increase a volume and/or area of the peripheral inlet 426 and the passageway 428. This can advantageously help improve the drainage of the drain system 400 and direct fluid toward the drain opening. In an embodiment, each support in the plurality of support members 422 can include a body 434 that extends radially outward and downward from the tray 404. The body 434 may allow the tray 404 to be supported and positioned on the frame 402. An example of such a body 434 is emphasized in FIG. 7C.

Figure 7C:
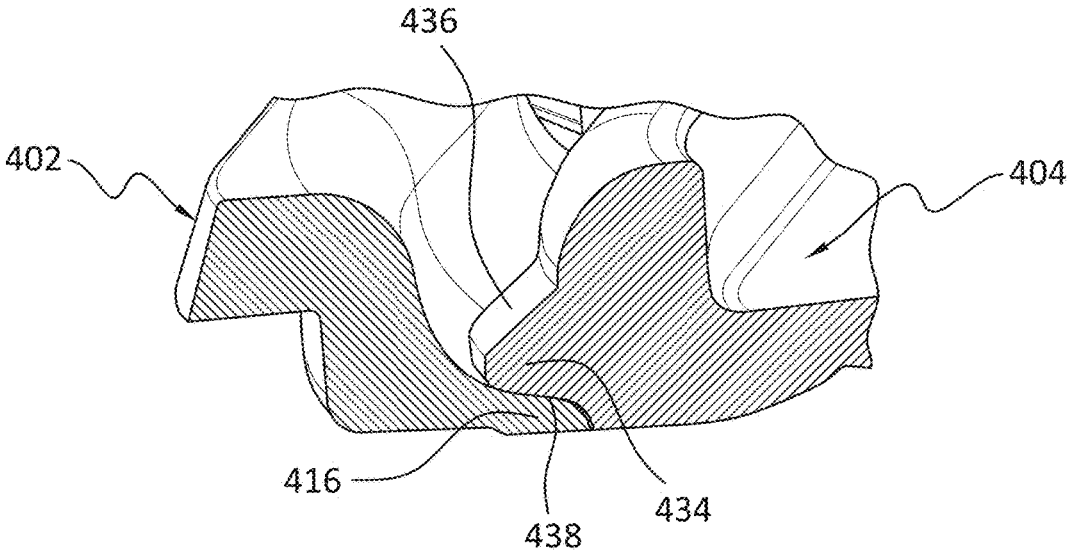
FIG. 7C is a cross-section view of a portion of the frame and tray of FIG. 4 according to an embodiment.
Figure 8:
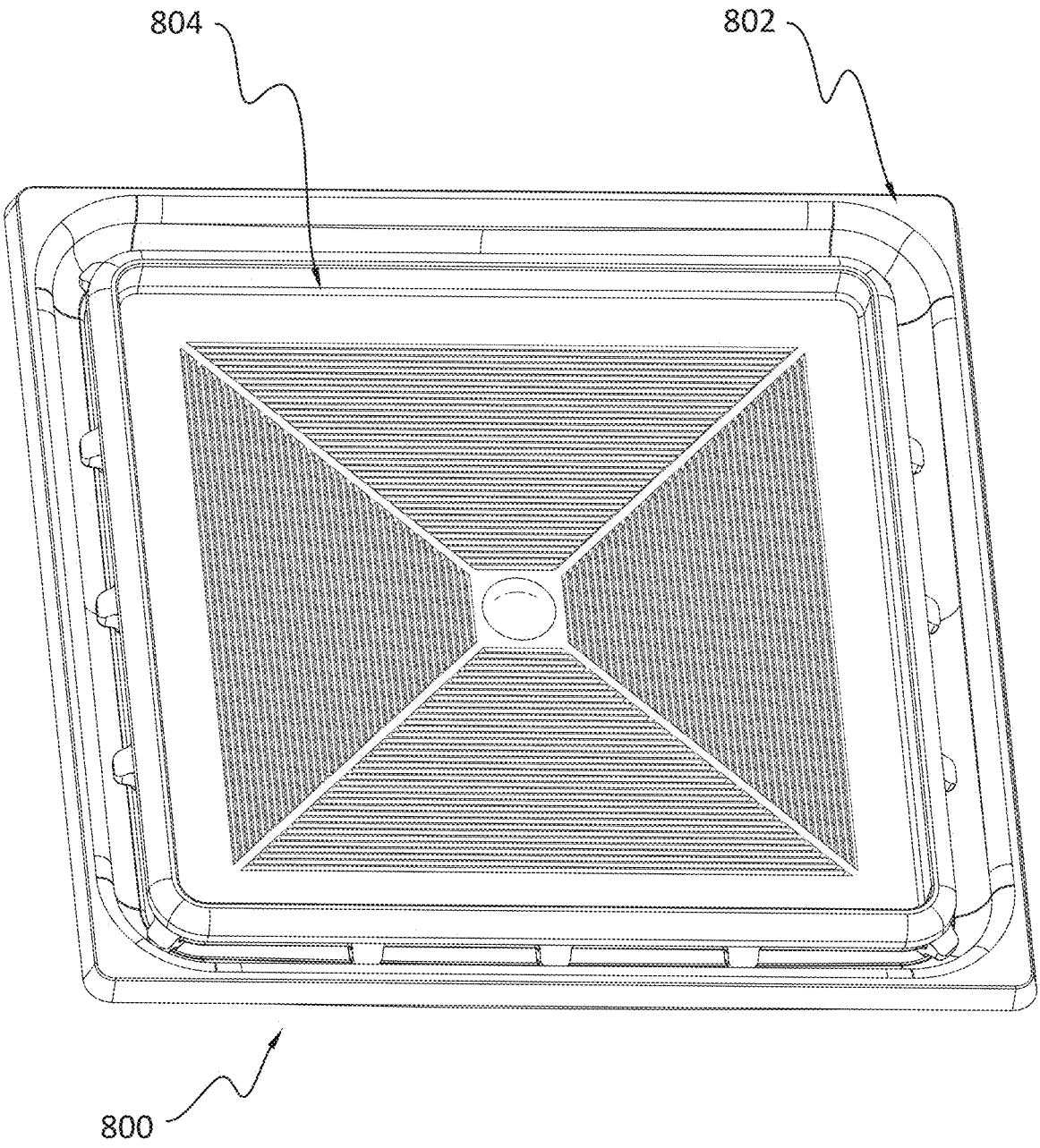
FIG. 8 is a top perspective view of a frame and tray according to another embodiment.
Figure 9:
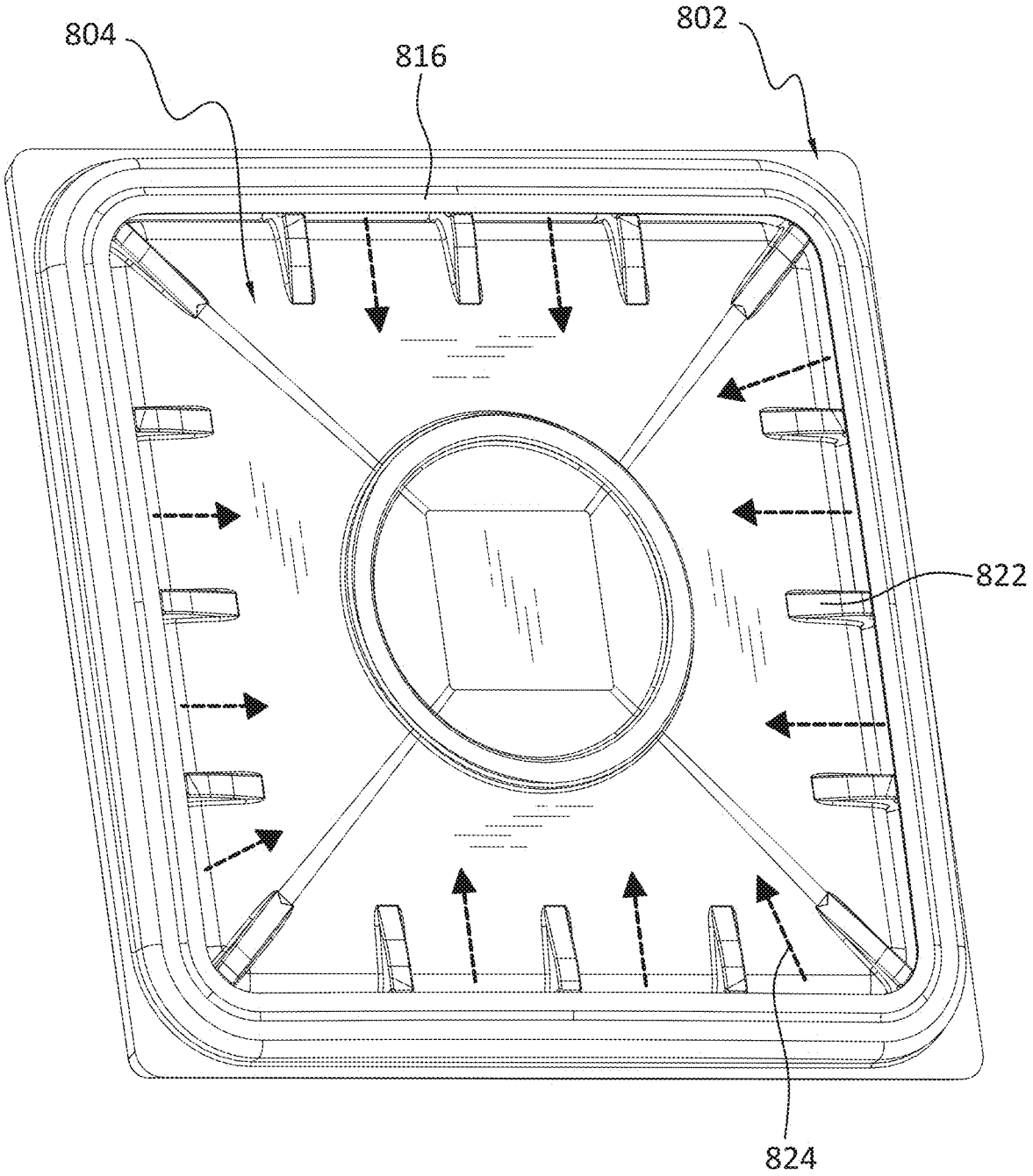
FIG. 9 is a bottom perspective view of the frame and tray of FIG. 8 according to an embodiment.

FIG. 7C shows that the body 434 of one or more of the many support members 422 has a upper surface 436. In one embodiment, the upper surface 436 can slope or angle downwardly away from the middle of the tray 404 when the tray 404 is placed in the frame 402. This downward slope can help keep water from accumulating on top of the many support members 422. This can improve overall water flow through the many fluid paths 424. In an embodiment, a bottom surface 438 of the body 434 can have a shape configured to interface with and fit on the base portion 416 of the frame 402. The bottom surface 438 can have a concave or any other suitable shape to interface with the base portion 416. This can help position and locate the tray 404 on the frame 402.

FIGS. 8-11 show another exemplary embodiment of a drain system 800 comprising a frame 802 and a tray 804, including a plurality of support members 822, as described herein. Embodiments of the present disclosure can have any suitable shape. For example, the frame 802 can have a substantially square shape and the tray 804 can have a shape substantially corresponding to the substantially square shape of the frame 802. The plurality of support members 822 can have a wedge-like shape protruding below and radially outward from a bottom of the tray 804.

Like in other embodiments, the tray 804 may be removably positioned on the frame 802. The tray 804 can include a plurality of support members 822 distributed about a bottom or underside of the tray 804 and configured to interface with the base portion 816 of the frame 802. The support members 822 may be positioned and sized to define one or more fluid paths 824 between or in fluid communication with a tile floor and a drain opening below the frame 802. In an embodiment, the one or more fluid paths 824 can include a peripheral inlet 826 extending around the tray 804 between the frame 802 and the tray 804 when the tray 804 is positioned on the frame 802. The one or more fluid paths 824 may extend between the support members 822 and between the underside of the tray 804 and the frame 802 when the tray 804 is placed on the frame 802, facilitating draining of fluid from the tile floor through the drain system 800 and substantially concealing the drain system 800 in the tile floor. This beneficially helps create more visually appealing aesthetics in the tile floor. For instance, the drain system 800 can be advantageously integrated within the tile floor because the peripheral inlet 826 can be subtly positioned around and within the tiles and other portions of the drain system 800 are substantially hidden below the tile floor.

Optionally, the total area and/or volume of the one or more fluid paths 824 and/or the peripheral inlet 826 may substantially correspond to an area and/or volume of a drain opening and/or entry path of the drain body. In an embodiment, the peripheral inlet 826 can have an area that is at least as great as an area of the drain opening. In other embodiments, the peripheral inlet 826 can have an area substantially corresponding an area of the drain opening. This advantageously helps the drain system 800 handle a desired flow of fluid without causing excessive pressure drops or flow restrictions during use of the drain system 800.

Figure 10A:
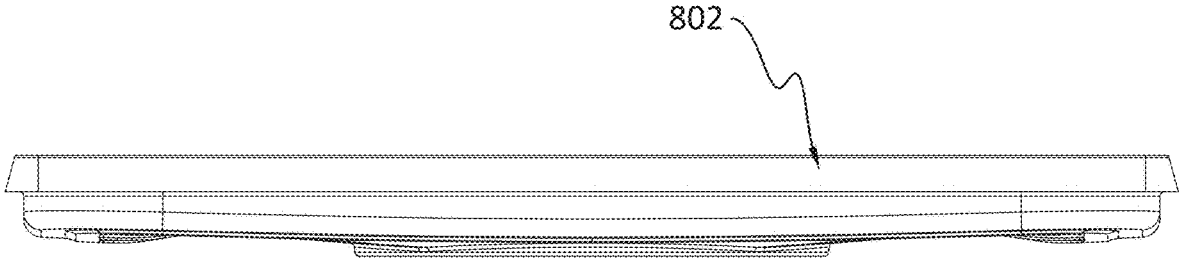
FIG. 10A is a side perspective view of the frame and tray of FIG. 8 according to an embodiment.
Figure 10B:
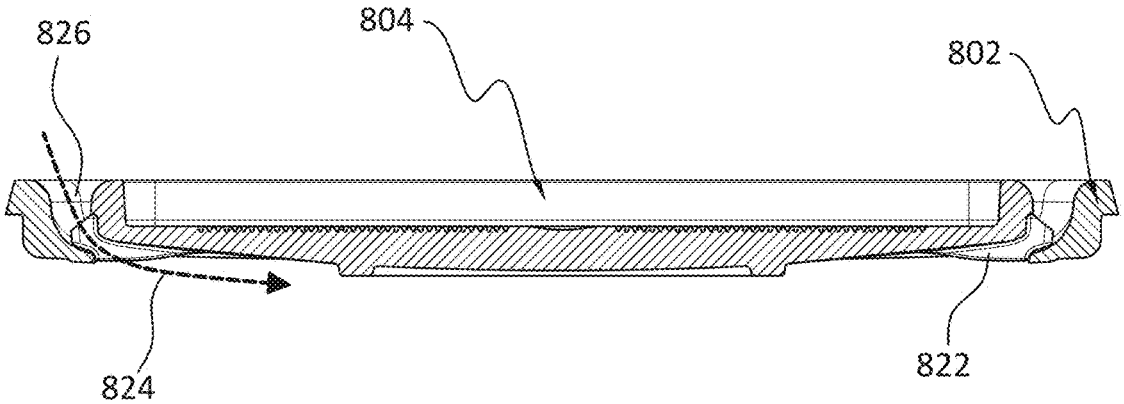
FIG. 10B is a cross section side view of the frame and tray of FIG. 8 according to an embodiment.

FIGS. 10A and 10B show a side view and a cross-sectional side view, respectively, of the drain system 800. As shown in FIG. 10B, the one or more fluid paths 824 may include spaces or gaps between the support members 822. The support members 822 may be configured and sized to define a gap or the peripheral inlet 826 between the wall portions of the frame 802 and the tray 804. The support members 822 can define at least some of the plurality of fluid paths 824 between a base portion 816 of the frame 802 and a bottom of the tray 804. The support members 822 may thus comprise one or more spacers and flow devices between the main body of the tray 804 and the frame 802.

Figure 11A:
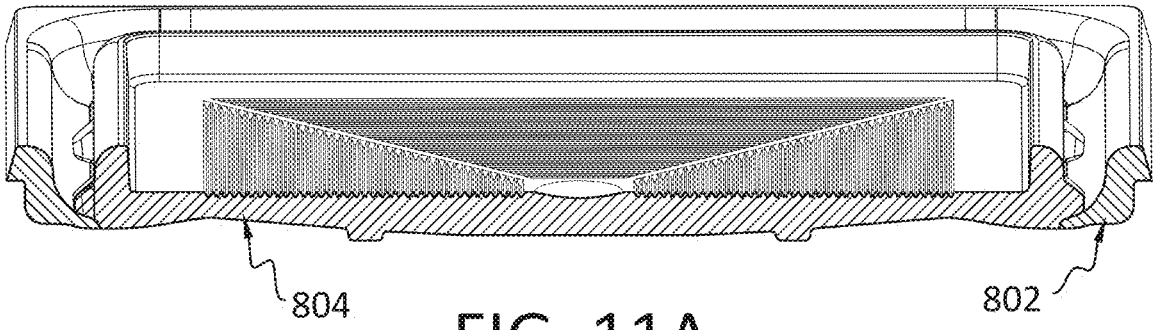
FIG. 11A is a cross section view of the frame and tray of FIG. 8 from a top perspective according to an embodiment.
Figure 11B:
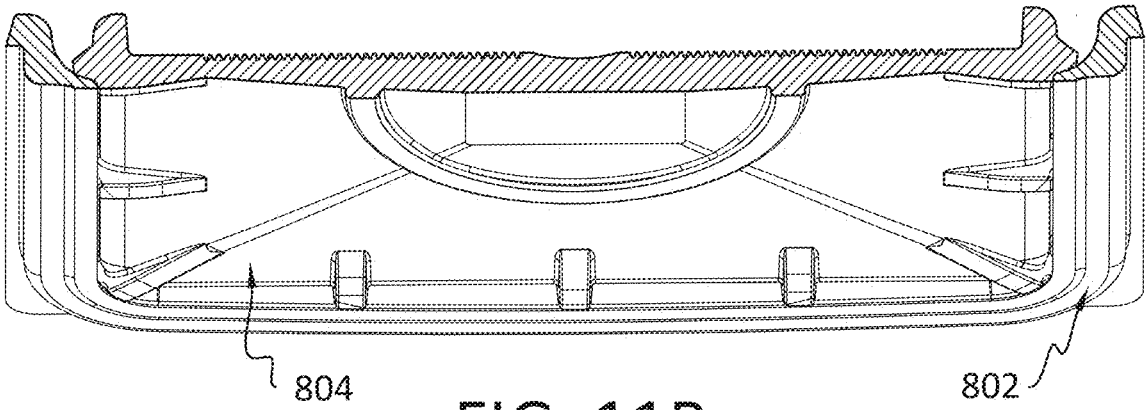
FIG. 11B is a cross section view of the frame and tray of FIG. 8 from a bottom perspective according to an embodiment.
Figure 11C:
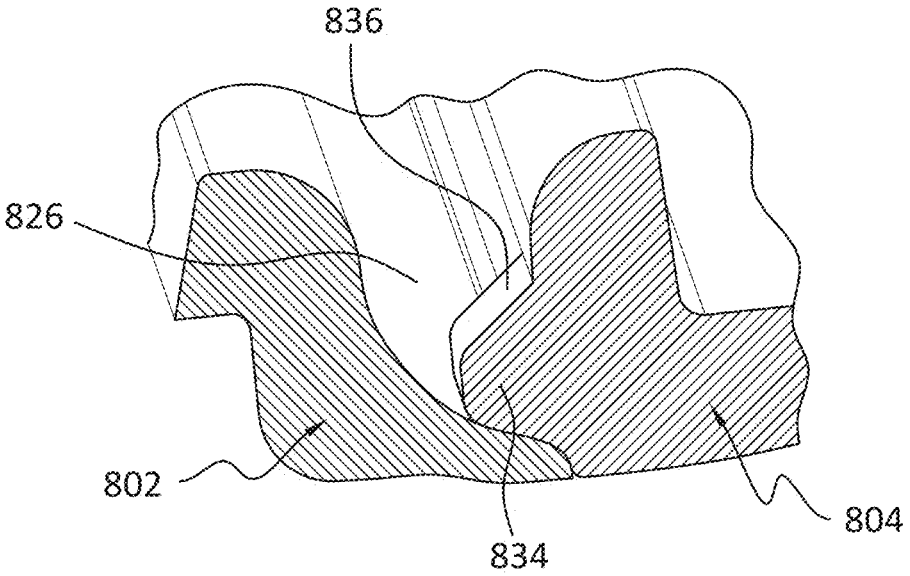
FIG. 11C is a cross-section view of a portion of the frame and tray of FIG. 8 according to an embodiment.

FIGS. 11A and 11B show a cross-section view of the frame 802 and tray 804 from a top and bottom perspective, respectively, according to an embodiment. FIG. 11C shows an example of a body 834 formed by a support of the plurality of support members. FIG. 11C also shows an upper surface 836 of the body 834. The upper surface 836 of the body 834 can angle downwardly into the peripheral inlet 826, improving fluid flow through the drain system 800. While a particularly shaped body 834 is shown, the body 834 is not limited to any particular shape, size, or any other feature or characteristic. For instance, the body 834 can have a length that is greater than a height of the body 834.

Figure 12:
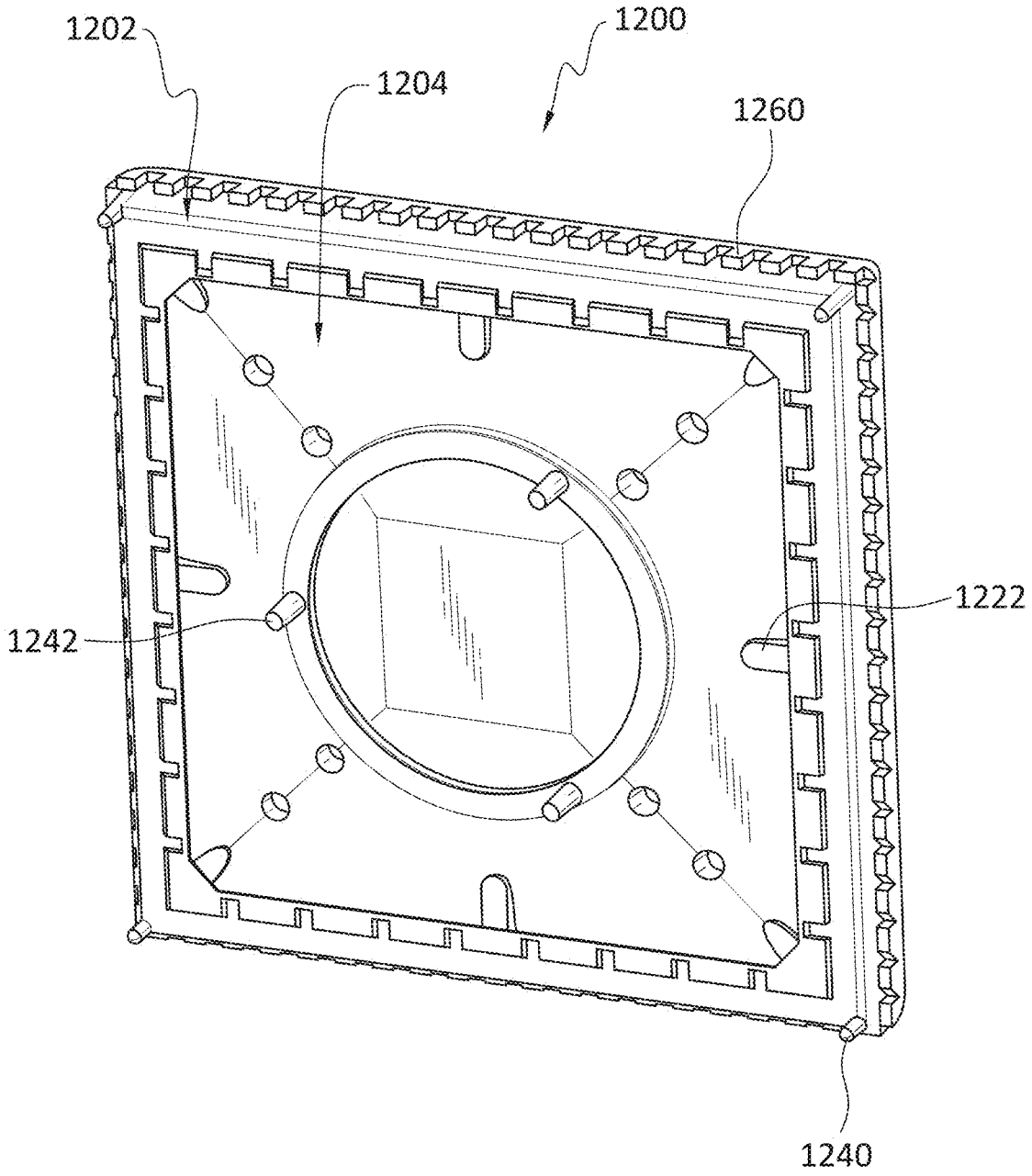
FIG. 12 is a bottom perspective view of a frame and tray according to another embodiment.
Figure 13:
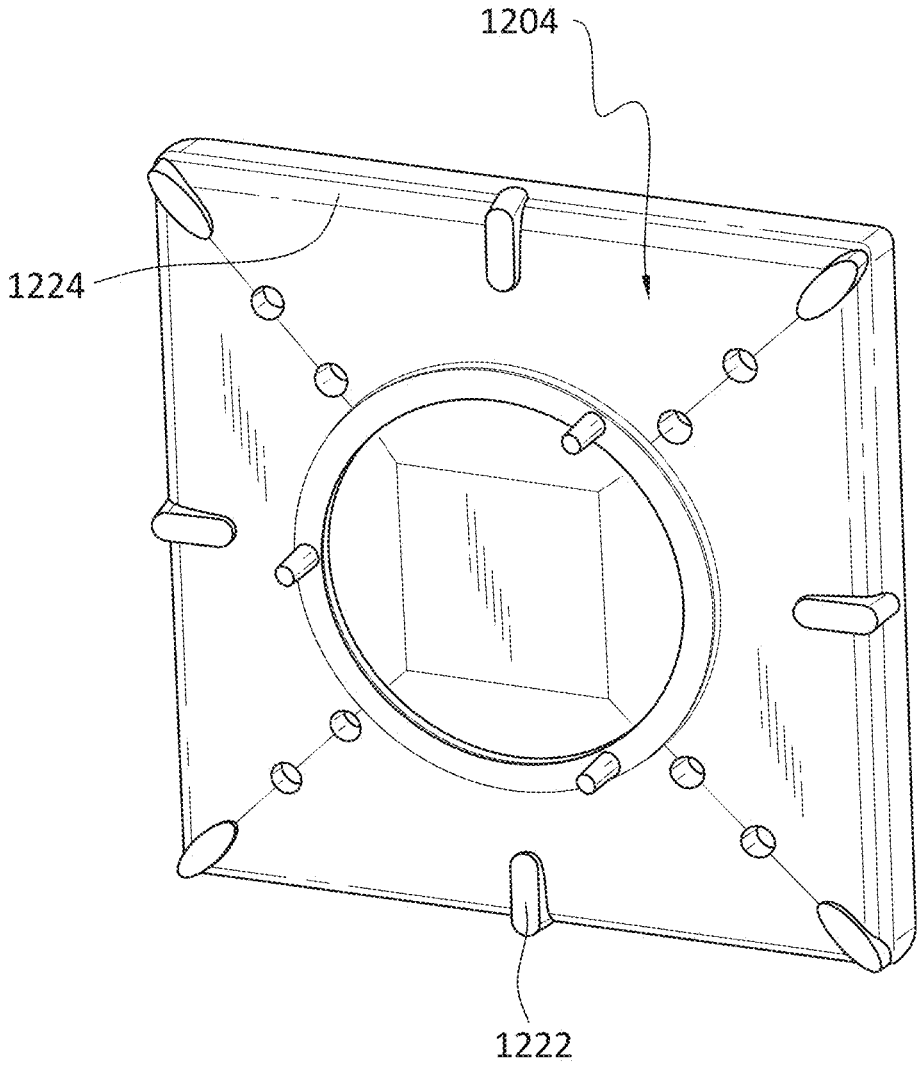
FIG. 13 is a bottom perspective view of the tray of FIG. 12 according to an embodiment.

FIGS. 12 and 13 show another embodiment of a drain system 1200 including a frame 1202 and a tray 1204. The tray 1204 can be removably positioned on the frame 1202. Like in other embodiments, the tray 1204 may include a plurality of support members 1222 distributed about a bottom or underside of the tray 1204 and configured to interface with the frame 1202. The plurality of support members 1222 may be positioned and sized to define one or more fluid paths 1224 between or in fluid communication with a tile floor and a drain opening below the frame 1202. In an embodiment, the one or more fluid paths 1224 can comprise a peripheral inlet extending around the tray 1204 between the frame 1202 and the tray 1204 when the tray 1204 is positioned on the frame 1202. As discussed, the one or more fluid paths 1224 may extend between the support members 1222 and between the underside of the tray 1204 and the frame 1202 when the tray 1204 is placed on the frame 1202, facilitating draining of fluid from the tile floor through the drain system 1200 and substantially concealing the drain system 1200 in the tile floor. This beneficially helps create more visually appealing aesthetics in the tile floor.

Optionally, the total area and/or volume of the one or more fluid paths 1224 and/or the peripheral inlet may substantially correspond to or exceed an area and/or volume of a drain opening and/or entry path of the drain body. In an embodiment, the one or more fluid paths 1224 can have an area substantially corresponding an area of the drain opening. This advantageously helping the drain system 1200 handle a desired flow rate or flow volume without causing excessive pressure drops or flow restrictions during use of the drain system 1200.

The drain system 1200 can have a square shape or any other suitable shape. The frame 1202 can include a plurality of grout locking features. For instance, the frame 1202 can include a plurality of ridges 1260 distributed around an outer peripheral of the frame 1202. The plurality of ridges 1260 may help retain grout between the frame 1202 and one or more tiles installed around the frame 1202. The plurality of ridges 1260 may also allow for a reduction in the movement of the frame 1202 once installed.

The plurality of support members 1222 may be similar to a plurality of support members described herein. In this embodiment, the plurality of support members 1222 are distributed evenly around the underside of a tray 1204, defining at least in part the plurality of fluid paths 1224 through which water may drain when the tray 1204 is set in the frame 1202. It will be appreciated embodiments described herein are not limited to any number of support members.

Optionally, the frame 1202 can include one or more height adjustment features. For example, the frame 1202 can include one or more stand-offs 1240 comprising one or more posts configured to elevate the frame 1202 relative to an underlying surface. To lower the height of the frame 1202, the one or more posts can be removed or broken away from the underside or lower surface of the frame 1202. This beneficially can help adjust the height of the frame 1202 relative to one or more surrounding tiles or tile members. While four posts are shown, the frame 1202 can include any number of posts or any other form of stand-offs 1240. It will be appreciated that the height adjustment features of the present disclosure can be incorporated into any of the embodiments described herein.

In other embodiments, the tray 1204 can include one or more centering features. For instance, the tray 1204 include one or more protrusions 1242 arranged to extend into and center the tray 1204 over a drain opening or pipe opening. In the embodiment shown, the one or more protrusions 1242 comprise three post members arranged in a triangular pattern to center and locate the tray 1204 on the drain opening or pipe opening. In other embodiments, the one or more protrusions 1242 can be four, five, two, or any other suitable number of protrusions 1242.

The one or more protrusions 1242 can comprise posts, arc segments, blocks, or any other suitable structure. If the tray 1204 is desired to be off-center relative to an underlying drain opening or pipe opening, the one or more protrusions 1242 can be removed or broken away from the underside or lower surface of the tray 1204. It will be appreciated that the centering features of the present disclosure can be incorporated into any of the embodiments described herein.

Figure 14:
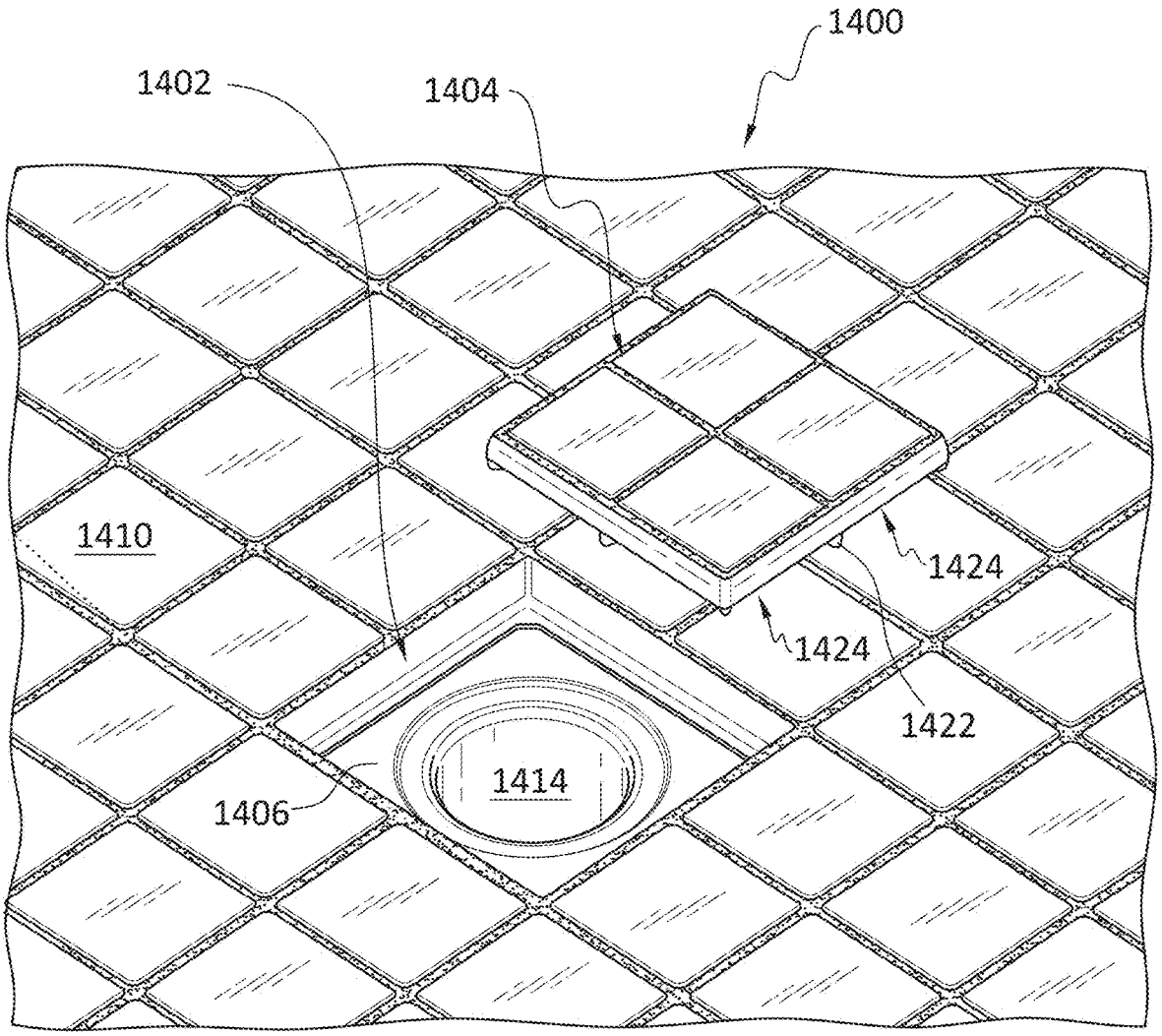
FIG. 14 shows a drain system in a partially disconnected configuration according to an embodiment.

FIG. 14 shows a drain system 1400 according to another embodiment installed in a tile floor 1410. A frame 1402 and tray 1404 are shown, in which the tray 1404 carries one or more tiles 1408 that visually conform to other tiles used in the surrounding tile floor 1410. Like in other embodiments, the tray 1404 may include a plurality of support members 1422 distributed about a bottom or underside of the tray 1404 and configured to interface with the frame 1402. The support members 1422 may be positioned and sized to define one or more fluid paths 1424 between a tile floor 1410 and a drain opening 1414 below the frame 1402. In an embodiment, the one or more fluid paths 1424 can comprise a peripheral inlet 1426 extending around the tray 1404 between the frame 1402 and the tray 1404 when the tray 1404 is positioned on the frame 1402. As discussed, the one or more fluid paths 1424 may extend between the support members 1422 and between the underside of the tray 1404 and the frame 1402 when the tray 1404 is placed on the frame 1402, facilitating draining of fluid from the tile floor through the drain system 1400 and substantially concealing the drain system 1400 in the tile floor. This beneficially helps create more visually appealing aesthetics in the tile floor. For instance, the drain system 1400 can be advantageously integrated within the tile floor because the peripheral inlet 1426 can be subtly positioned around and within the tiles and other portions of the drain system 1400 are substantially hidden below the tile floor.

In FIG. 14, the tray 1404 is removed to the side of a drain body 1406 having a drain opening 1414 for illustrative purposes. The tray 1404 defines the plurality of support members 1422 that at least in part define the one or more fluid paths 1424 to the drain opening 1414 between the frame 1402 and the tray 1404 once the tray 1404 is set in the frame 1402 in the tile floor 1410. The support members 1422 may be configured in any suitable manner to permit the passage of fluid into the drain opening 1414 between the frame 1402 and the tray 1404.

Figure 15:
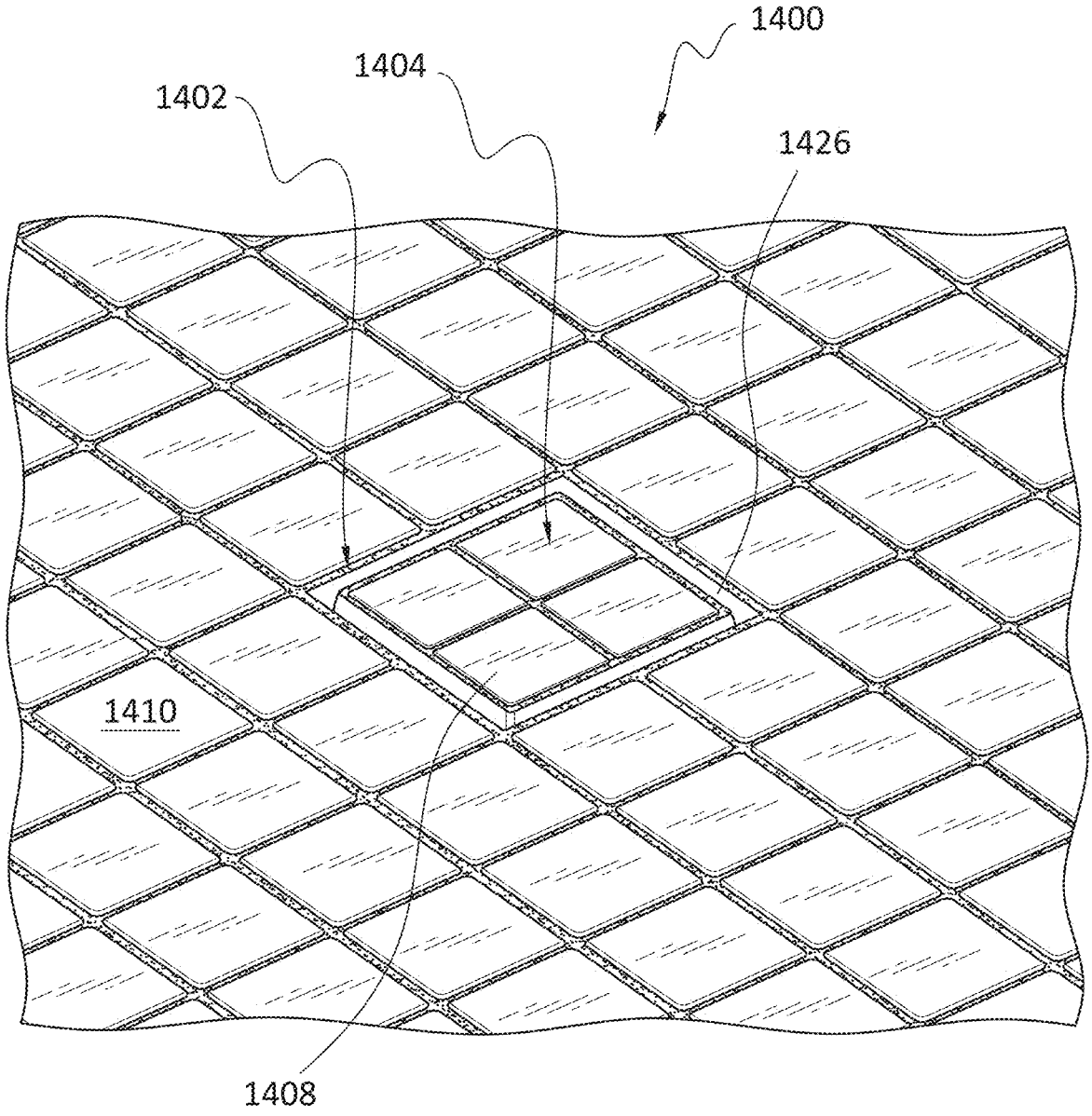
FIG. 15 shows the drain system of FIG. 14 in a connected configuration according to an embodiment.

FIG. 15 shows the tray 1404 positioned on the frame 1402 over the drain opening 1414. As seen the plurality of support members 1422 at least part positions the tray 1404 to form the peripheral inlet 1426 around the drain system 1400. The peripheral inlet 1426 can be in fluid communication with the one or more fluid paths 1424 and the drain opening 1414 below the tray 1404. It will be appreciated that such a configuration may allow for a thinner and lower profile drain system and allow for other benefits described herein.

Figure 16:
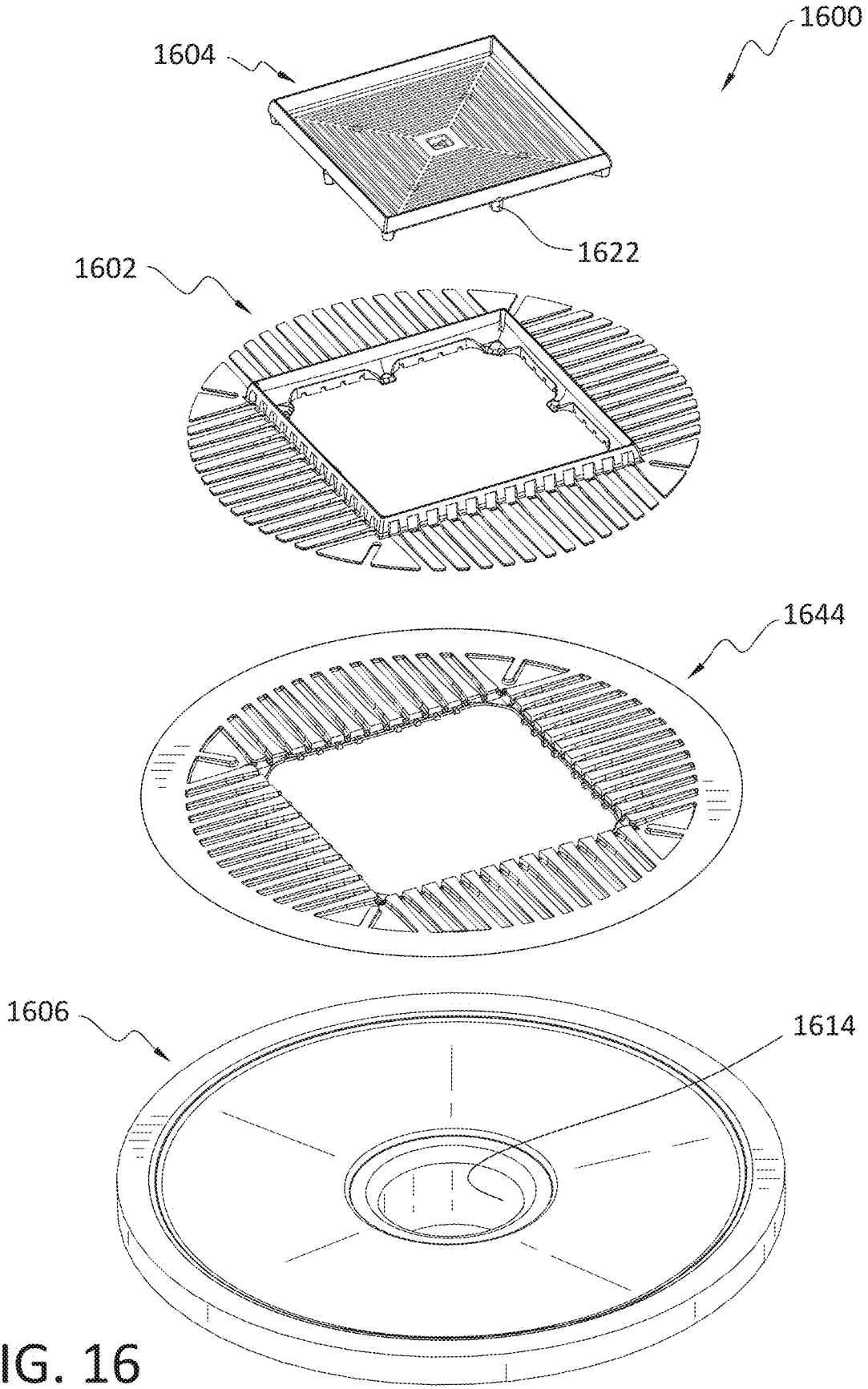
FIG. 16 is a perspective exploded view of a drain system according to another embodiment.
Figure 17:
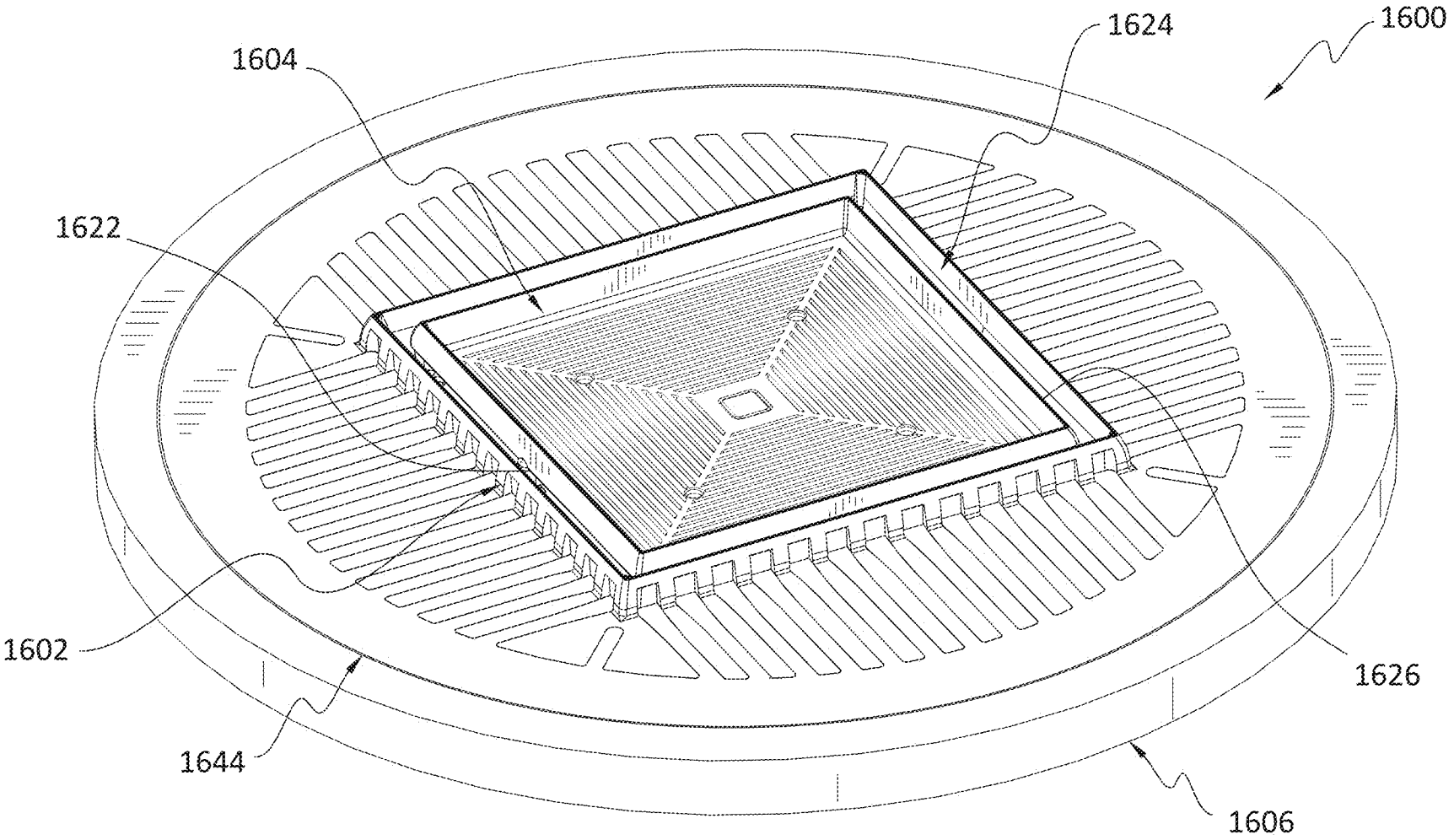
FIG. 17 is a perspective assembled view of the drain system of FIG. 16 according to an embodiment.

FIGS. 16 and 17 show a drain system 1600 according to another embodiment. A frame 1602 and a tray 1604 are positionable over a drain opening 1614 of a drain body 1606. The tray 1604 can be configured to carry one or more tiles 1608 (shown in FIG. 23) in a tile floor 1610 (shown in FIG. 23). Like in other embodiments, the tray 1604 can include a plurality of support members 1622 distributed about a bottom or underside of the tray 1604 and configured to interface with the frame 1602. The support members 1622 may be positioned and sized to define one or more fluid paths 1624 between the tile floor 1610 and the drain opening 1614 below the frame 1602. In an embodiment, the one or more fluid paths 1624 can comprise a peripheral inlet 1626 extending circumferentially around the tray 1604 between the frame 1602 and the tray 1604 when the tray 1604 is positioned on the frame 1602. As discussed, the one or more fluid paths 1624 may extend between the support members 1622 and between the underside of the tray 1604 and the frame 1602, facilitating draining of fluid from the tile floor 1610 through the drain system 1600 and substantially concealing the drain system 1600 in the tile floor 1610. This beneficially helps create more visually appealing aesthetics in the tile floor 1610. For instance, the drain system 1600 can be advantageously integrated within the tile floor 1610 because the peripheral inlet 1626 can be subtly positioned around and within the tiles and other portions of the drain system 1600 are substantially hidden below the tile floor 1610.

Optionally, the total area and/or volume of the one or more fluid paths 1624 and/or the peripheral inlet 1626 may substantially correspond to an area and/or volume of the drain opening 1614 and/or entry path of the drain body 1606. For instance, the peripheral inlet 1626 can have an area substantially corresponding to or exceeding an area of the drain opening 1614. This advantageously can help the drain system 1600 handle a desired fluid flow from the tile floor 1610 without causing excessive pressure drops or flow restrictions during use of the drain system 1600.

In an embodiment, the tray 1604 can have a varying cross-sectional shape to help improve fluid flow through the drain system 1600. For instance, the tray 1604 can have a cross-section thickness that increases from a radial outer portion of the tray 1604 toward a radial center portion of the tray 1604 such that the cross-section thickness of the tray 104 is thinner toward the radial center portion of the tray 1604. This can increase a volume and/or area of the one of more fluid paths 1624 between the tray 1604 and the frame 1602 toward the outer portion of the tray 1604. The one or more fluid paths 1624 can be in fluid communication with the tile floor 1610 and the drain opening 1614. This advantageously helps to improve flow or drainage into the drain system 1600 and to direct fluid from the tile floor 1610 toward the drain opening 1614.

According to an embodiment, the frame 1602 can have a floating configuration that allows for lateral adjustment or a degree of misalignment between the opening of the frame 1602 and the drain opening 1614 in various positions, which, in turn, allows the frame 1602 to accommodate different conditions that may present themselves during a tile installation. This beneficially allows the position of the frame 1602 over the drain opening 1614 to be movable or adjusted as needed such as required due to the presence of a wall extending over the drain body 1606, and/or to accommodate tile anomalies or other undesirable conditions. The floating configuration of the frame 1602 also allows the frame 1602 to be compatible with different drain components. During installation, the frame 1602 does not extend downwardly into the drain opening 1614 such that the frame 1602 is floatable over the drain opening 1614 for lateral and/or rotational adjustment of the frame 1602 relative to the drain opening 1614.

Optionally, the drain system 1600 can include weep protector 1644 positionable between the drain body 1606 and the frame 1602. The weep protector 1644 can be configured to interface with the frame 1602 and help direct water and fluids that seep through the tile floor 1610 toward weep openings in the frame and to help protect the weep openings from external elements, like debris and mortar from blocking the weep openings.

Figures 18, 19:
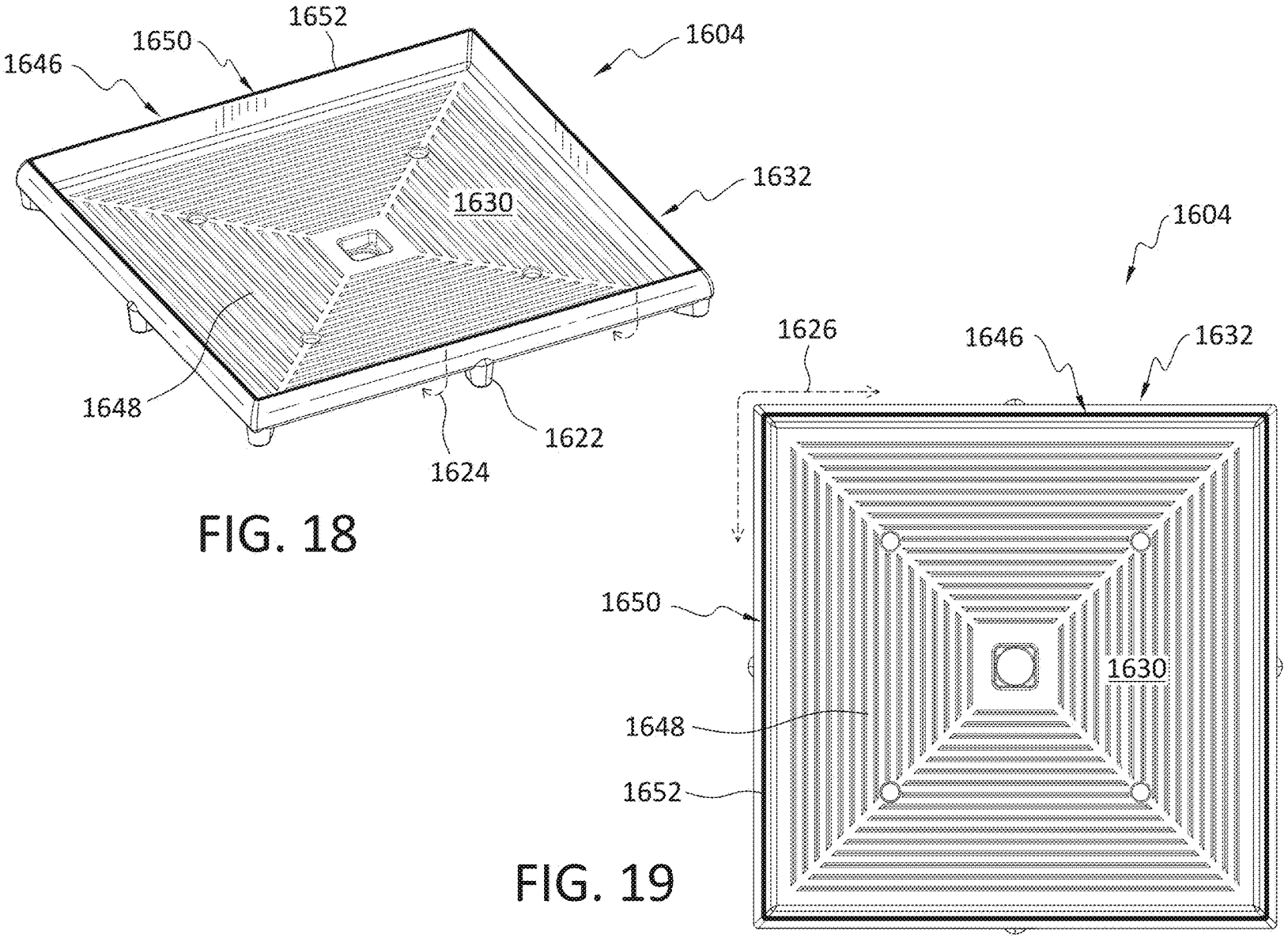
FIG. 18 is a perspective view of the tray of FIG. 16 according to an embodiment.
FIG. 19 is a top view of the tray of FIG. 16 according to an embodiment.

Referring now to FIGS. 18 and 19, the tray 1604 includes a wall portion 1632 extending around the tray 1604 that defines a recessed portion 1630 configured to hold one or more tiles. The wall portion 1632 can include a height defined between an underside of the tray 1604 and an upper surface 1646 of the tray 1604. The upper surface 1646 can include a width defined between a radial outer surface of the wall portion 1632 and a radial inner surface of the wall portion 1632.

Optionally, a bottom portion 1648 of the recessed portion 1630 can include one or more features to help with adhesion of one or more tiles within the recessed portion 1630 of the tray 1604. For instance, at least a region of the bottom portion 1648 of the recessed portion 1630 can include a textured surface comprising a series of grooves as shown. The bottom portion 1648 of the recessed portion 1630 can also include one or more through holes for allowing moisture to exit between the tiles and the tray 1604 and/or help lock grout or mortar applied to the recessed portion 1630. The one or more openings may also be configured to receive a fastener in other configurations.

Figure 23:
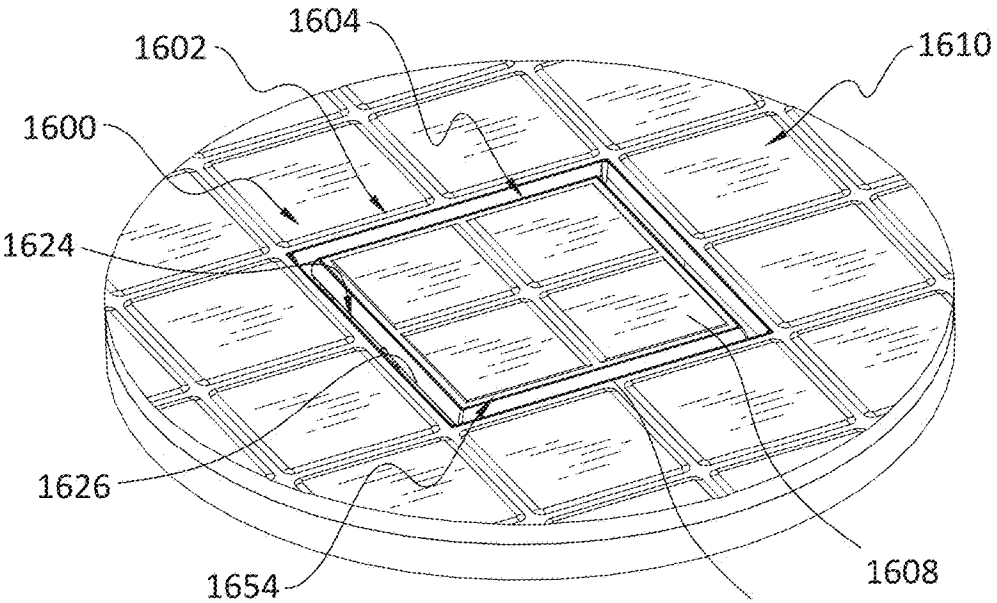
FIG. 23 is a perspective view of the drain system of FIG. 16 installed in tiles according to an embodiment.

According to an embodiment, the drain system 1600 can include one or more concealment features 1650 to help enhance the visual continuity of the tile floor 1610 after the drain system 1600 is installed. For instance, the one or more concealment features 1650 can comprise the upper surface 1646 of the wall portion 1632 of the tray 1604 having a slender configuration relative to the height of the wall portion 1632. By way of example, a ratio between the width of the upper surface 1646 and the height of the wall portion 1632 of the tray 1604 can be less than about 5%, less than about 8%, less than about 9%, less than about 10%, or less than about 15%. This slender configuration of the wall portion 1604 advantageously helps to minimize the visibility of the tray 1604 once installed in the tile floor 1610. For example, the slender configuration of the upper surface 1646 can help ensure the tray 1604 blends more seamlessly into the surrounding tiles, reducing the likelihood of the drain system 1600 standing out or disrupting the visual continuity of the tile floor 1610 (as shown in FIG. 23). In an embodiment, the one or more concealment features 1650 can comprise an obscuring finish 1652 located along the upper surface 1646 of the wall portion 1632, further enhancing the ability of the tray 1604 to remain unobtrusive by reducing reflections or glare and/or by more closely mimicking the appearance of grout lines often located between tiles (as best shown in FIG. 23). For instance, the obscuring finish 1652 can comprise a black matte finish or may be selected based on the color of grout and/or tiles in the tile floor 1610. This configuration advantageously allows the tray 1604 to be more effectively hidden in the tile floor 1610, maintaining a sleek and a clean aesthetic while still supporting tiles and facilitating drainage.

Like in other embodiments, the plurality of support members 1622 can be distributed about a bottom or underside of the tray 1604 and configured to interface with a base portion 1616 of the frame 1602. One more of the plurality of support members 1622 may comprise a body member configured to support the tray 1604 on the frame 1602 and to offset the tray 1604 from the frame 1602 when the tray 1604 is positioned in on the frame 1602. This can allow the plurality of support members 1622 to locate the tray 1604 on the frame 1602 and define the one or more fluid paths 1624 between the tile floor 1610 and the drain opening 1614 below the frame 1602. In an embodiment, the one or more fluid paths 1624 can include a peripheral inlet 1626 extending around the tray 1604 between the frame 1602 and the tray 1604 when the tray 1604 is positioned on the frame 1602 as shown in FIG. 17. The one or more fluid paths 1624 may extend between the support members 1622 and between the underside of the tray 1604 and the frame 1602, allowing for efficient and discreet flow of fluid from the tile floor 1610 into the drain body 1606. The plurality of support members 1622 can have any suitable configuration. For instance, the plurality of support members 1622 can extend downwardly from a bottom of the tray 1604 and be configured to interact with one or more seats defined on the base portion 1616, helping to locate and offset the tray 1604 from the frame 1602. In other embodiments, the plurality of support members 1622 can extend radially outwardly a distance from the bottom of the tray 1604.

The tray 1604 can be formed of a metal material such as aluminum or steel, or of a rigid polymeric or ceramic or other material. In other embodiments, the frame 1602 can be flexible or semiflexible to provide some tolerance in a fit between the tray 1604 and/or the tile floor 1610.

Figure 21:
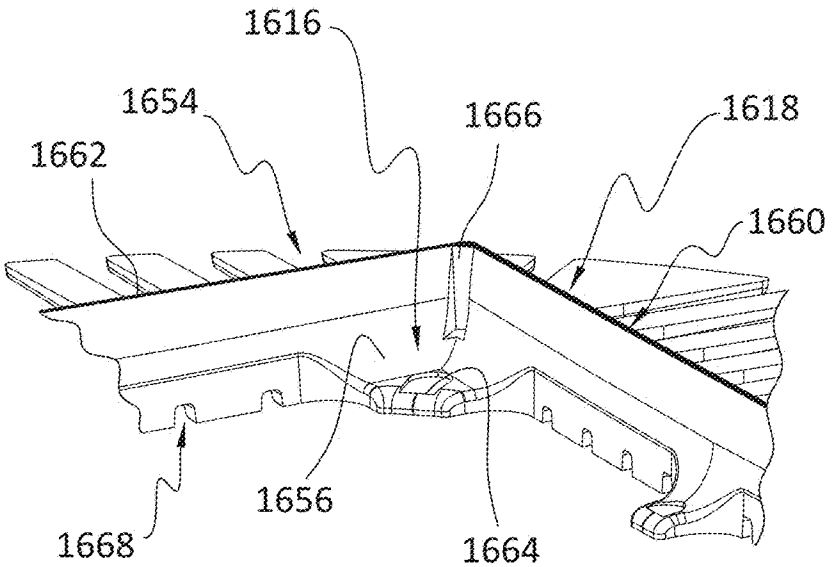
FIG. 21 is a detailed view of the frame of FIG. 16 according to an embodiment.
Figure 20:
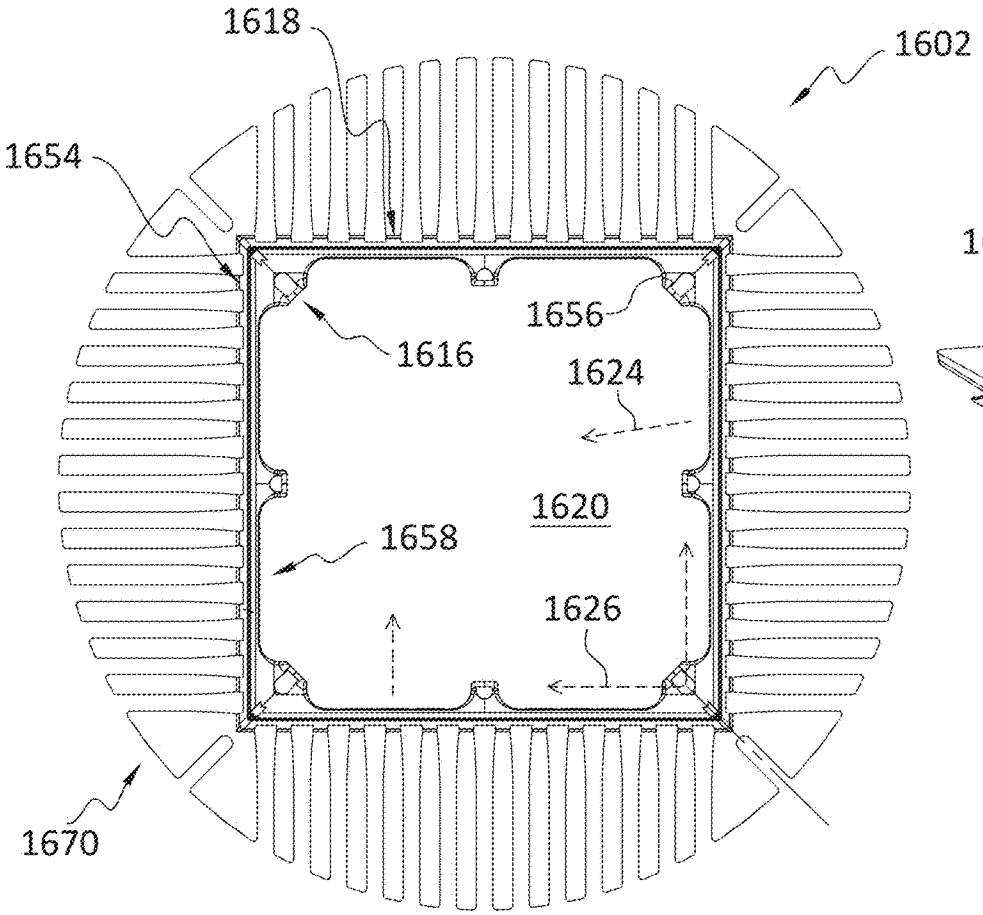
FIG. 20 is a top view of the frame of FIG. 16 according to an embodiment.

FIGS. 20 and 21 show the frame 1602 comprises a base portion 1616 and a wall portion 1618 projecting upwardly from the base portion 1616. The wall portion 1618 can include a height defined between an underside of the frame 1602 and an upper surface 1654 of the frame 1602. The upper surface 1654 can include a width defined between a radial outer surface of the wall portion 1618 and a radial inner surface of the wall portion 1618.

The base portion 1616 extends radially inward from a lower region of the wall portion 1618 towards the drain opening 1614 when the frame 1602 is positioned on the drain body 1606 and defines a through opening 1620 positionable about the drain opening 1614 of the drain body 1606. In the illustrated embodiment, the base portion 1616 comprises a plurality of feet members 1656 spaced apart around the frame 1602 or the radial inner surface of the wall portion 1618 and defining open spaces 1658 between the plurality of feet members 1656. The feet members 1656 can be configured to support the support members 1622 and the open spaces 1658 can be sized and configured to improve flow through the drain system 1600 by reducing drag and increasing the flow area of the one or more fluid paths 1624. This advantageously can help to improve flow or drainage into the drain system 1600 and to direct fluid from the tile floor 1610 toward the drain opening 1614. A transition between the base portion 1616 and the wall portion 1618 can comprise a curved surface, helping to improve flow characteristics through the peripheral inlet 1626.

The frame 1602 can include one or more concealment features 1660 to help enhance the visual continuity of the tile floor 1610. For instance, the one or more concealment features 1660 can comprise the upper surface 1654 of the wall portion 1618 having a slender configuration, advantageously helping to minimize the visibility of the frame 1602 once installed in the tile floor 1610. By way of example, a ratio between the width of the upper surface 1654 of the frame 1602 and the height of the wall portion 1618 can be less than about 5%, less than about 8%, less than about 9%, less than about 10%, or less than about 15%.

In an embodiment, the one or more concealment features 1660 can comprise an obscuring finish 1662 located along the upper surface 1654, further enhancing the ability of the frame 1602 and drain system 1600 to remain unobtrusive by reducing reflections or glare and by more closely mimicking the appearance of grout lines often located between tiles. For instance, the obscuring finish 1662 can comprise a black matte finish or may be selected based on the color of grout and/or tiles. This configuration allows the drain system 1600 to be more effectively hidden in the tile floor 1610, maintaining a sleek and a clean aesthetic while still supporting tiles and facilitating drainage as best shown in FIG. 23. It will be appreciated that in other embodiments, the one or more concealment features 1660 can be located on other surfaces of the drain system 1600 and/or can comprise different types of finishes.

According to an embodiment, one or more of the plurality of feet members 1654 can define a seat portion 1664 sized and configured to engage with and position a bottom of the plurality of support members 1622. This advantageously can help locate and maintain the position of the tray 1604 on the frame 1602. Optionally, the wall portion 1618 of the frame 1602 can define one or more features to locate a drain cover on the drain system 1600. For instance, the wall portion 1618 of the frame 1602 can define one or more guiding slots 1666 configured to receive and guide a positioning feature defined on a drain cover to locate and/or attach the drain cover on the frame 1602. In an embodiment, the frame 1602 can have a lower profile. For instance, the height of the wall portion 1618 can be about ¼ inches, about ⅜ inches, or any other suitable height. Such a configuration beneficially allows for a lower profile drain system and improves aesthetics.

The frame 1602 and the tray 1604 are shown having a square configuration. In other embodiments, the frame 1602 and/or the tray 1604 can have a circular, rectangular, hexagonal, and/or any other suitable shape.

Referencing FIG. 21, the frame 1602 can define one or more weep openings 1668 configured to help manage and facilitate water drainage. For example, in the tile floor 1610, water can penetrate the grout lines and seep beneath the tile into the substrate or subflooring beneath the tile. The one or more weep openings 1668 can allow such trapped water and other fluids to drain toward the drain opening 1614 through the frame 1602 structure, preventing it from accumulating under the tiles and causing water damage. The one or more weep openings 1668 are shown having a rounded trapezoidal shape and being distributed around a bottom of the wall portion 1618 below the base portion 1616 but it will be appreciated the one or more weep openings 1668 can be configured in any suitable location and in any suitable shape.

According to an embodiment, the drain system 1600 can include one or more features to help create continuity between the drain system 1600 and adjacent tiles. For instance, the drain system 1600 can include one or more radial support extensions 1670 extending radially outward from a bottom portion of the frame 1602. The one or more radial support extensions 1670 can be configured to extend below adjacent tiles and mortar supporting adjacent tiles, providing enhanced continuity between the frame 1602 and the tiles. This can allow the one or more radial support extensions 1670 to selectively support and/or elevate adjacent tiles relative to the drain body 1606, increasing the compatibility of the drain system 1600 with tiles of different sizes and thicknesses. It is also advantageous because it increases a contact area between the frame 1602 and the drain body 1606, which, in turn, can help stabilize the frame 1602 on the drain body 1606. This can be particularly advantageous if the frame 1602 is installed off center of the drain opening 1614.

In the illustrated embodiment, the one or more radial support extensions 1670 are elongated and spaced apart around the frame 1602. The one or more weep openings 1668 can be positioned in and/or aligned with the spaces between the one or more weep openings 1668. This advantageously helps the one or more radial support extensions 1670 channel and/or direct weeping water toward the one or more weep openings 1668 and protect the one or more weep openings 1668 from being blocked. It will be appreciated that the size and shape of the one or more weep openings 1668 can be selected or varied. In the illustrated embodiment, the one or more radial support extensions 1670 project outward symmetrically from the outer radial side of the frame 1602 and are uniformly spaced. In an embodiment, the one or more radial support extensions 1670 comprise a combination of elongated, straight members and triangular members at or near corners of the frame 1602. This can provide reinforcement and stability to the frame 1602 and well as enhance a load distribution of tiles installed over the one or more radial support extensions 1670. If one or more of the radial support extensions 1670 are not needed, they can be configured to be removed or broken off the frame 1602 in an embodiment.

Figure 22:
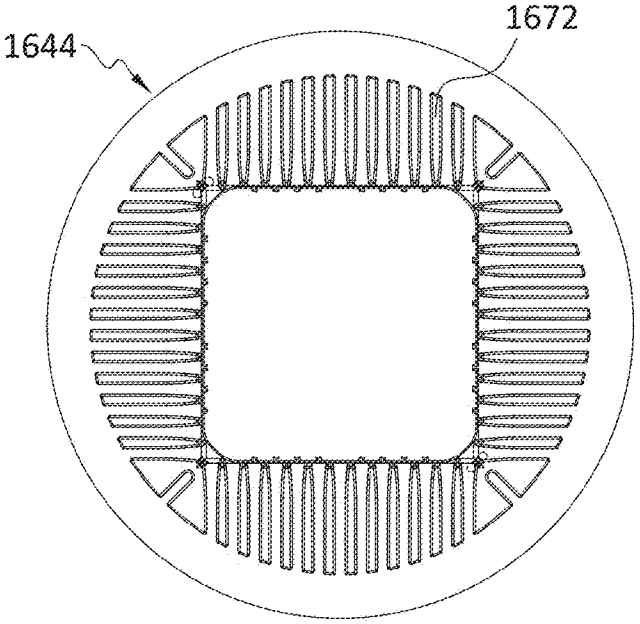
FIG. 22 is a top view of the weep protector of FIG. 16 according to an embodiment.

FIG. 22 shows the weep protector 1644 according to an embodiment. As seen, the weep protector 1644 can be shaped similarly to the frame 1602 but oversized relative to the frame 1602 such that the entirety of the frame 1602 can rest on the weep protector 1644. In the illustrated embodiment, the weep protector 1644 can have a generally circular peripheral shape and define a generally square central opening substantially corresponding to the opening 1620 of the frame 1602. In the illustrated embodiment, the upper surface refines a plurality of receiving spaces 1672 corresponding to the one or more radial support extensions 1670 of the frame 1602. The plurality of receiving spaces 1672 can help fit and locate the frame 1602 on the weep protector 1644 when the weep protector 1644 is used with the drain system 1600.

Figure 24:
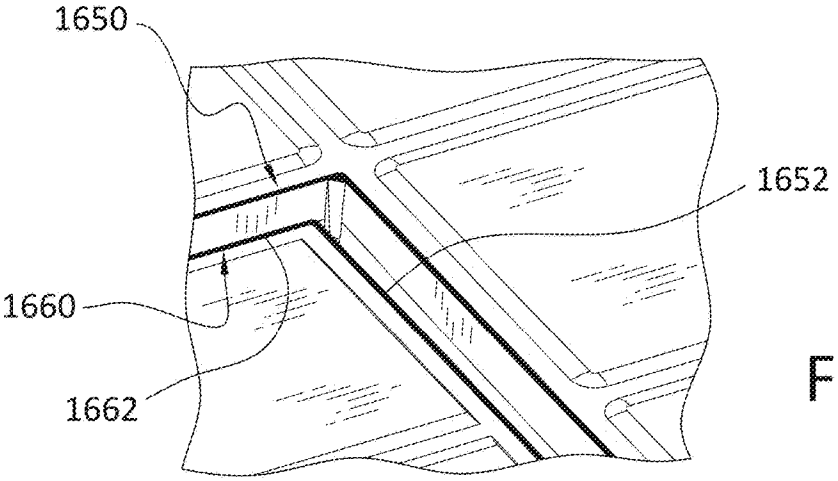
FIG. 24 is detailed view of the installed drain system shown in FIG. 23 according to an embodiment.

FIGS. 23 and 24 shows the drain system 1600 installed in the tile floor 1610. As seen, the tray 1604 can carry one or more tiles 1608 and can be positioned on the frame 1602 over the drain opening 1614 (shown in FIG. 16) to form the peripheral inlet 1626 between the frame 1602 and the tray 1604. As discussed above, the peripheral inlet 1626 can be in fluid communication with the one or more fluid paths 1624 and the drain opening 1614, allowing for efficient and discreet flow of fluid from the tile floor 1610 into the drain body 1606.

As shown, the one or more concealment features 1660 of the tray 1604 and the one or more concealment features 1650 of the frame 1602 help enhance the visual continuity of the tile floor 1610. For example, the slender configuration and/or the obscuring finish 1662 of the upper surface 1646 of the tray 1604 advantageously help the drain system 1600 remain unobtrusive in the tile floor 1610. Similarly, the one or more concealment features 1650 of the frame 1602 help disguise the drain system 1600 within the one or more tiles 1608 in the tile floor 1610. The slender configuration and/or the obscuring finish 1652 of the upper surface 1654 of the frame 1602 help hide the peripheral inlet 1626 between the tiles 1608 in the tile floor 1610, maintaining a sleek and clean aesthetic while supporting the tiles 1608 and facilitating drainage.

Figure 26:
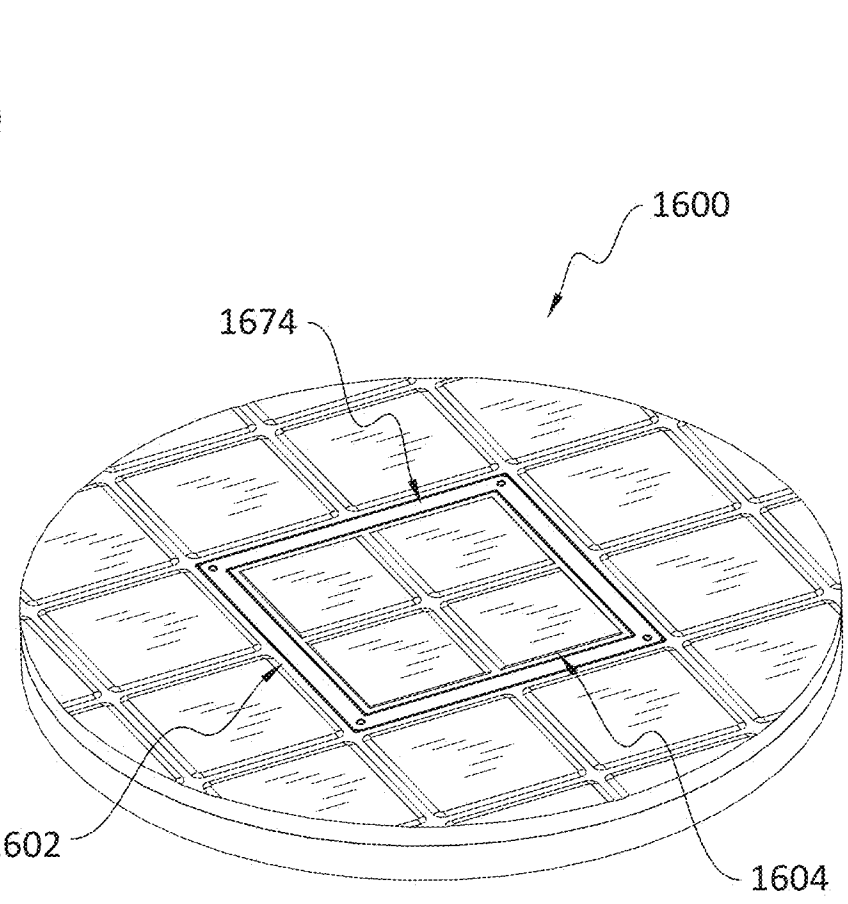
FIG. 26 is another perspective view of the construction cover of FIG. 25 according to an embodiment.
Figure 25:
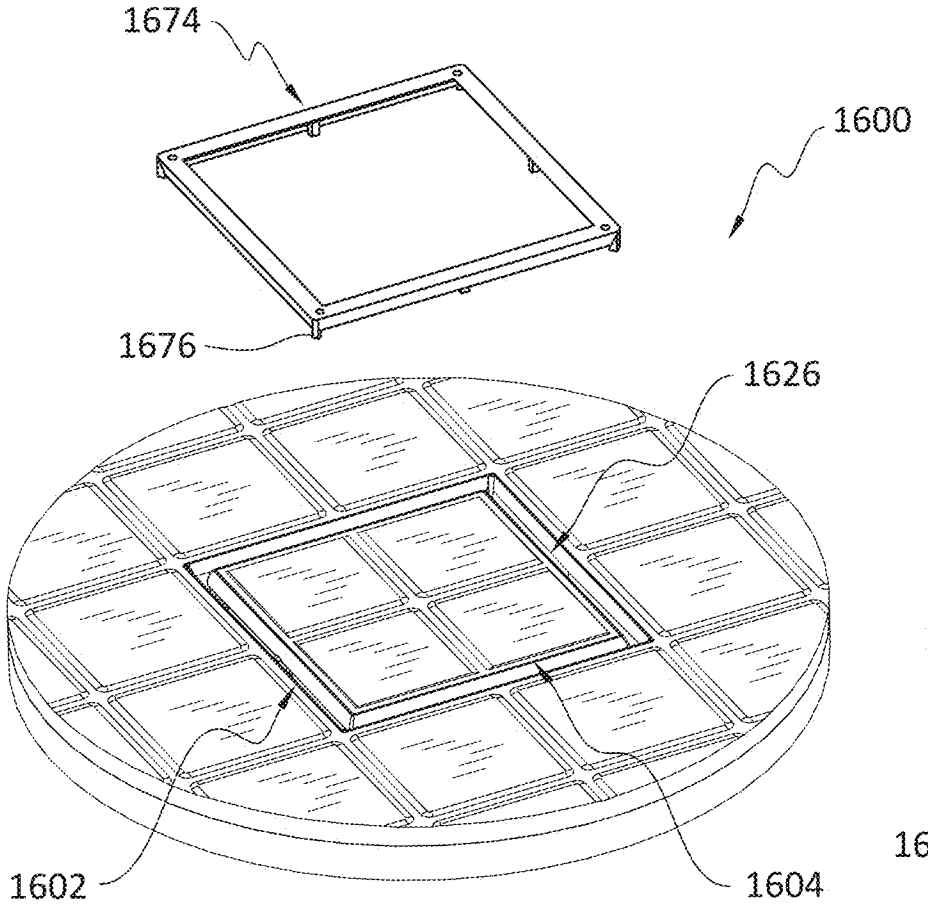
FIG. 25 is a perspective view of the drain system of FIG. 16 including a construction cover according to an embodiment.

Optionally, the drain system 1600 can include a construction plug 1674 sized and configured to be installed in the peripheral inlet 1626 between the frame 1602 and the tray 1604 as shown in FIGS. 25 and 26. The construction plug 1674 can have a temporary configuration for use during installation of the tile floor 1610, cleaning, and/or other purpose. The construction plug 1674 can comprise an upper surface having a solid or continuous or substantially continuous configuration arranged to prevent mortar and other debris from entering the drain opening 1614 when the construction plug 1674 is positioned in the peripheral inlet 1626. In the illustrated embodiment, the construction plug 1674 includes a plurality of post members 1676 corresponding to the guiding slots 1666 in the frame 1602. This beneficially allows the construction plug 1674 to be secured in the peripheral inlet 1626 when the construction plug 1674 is installed in the drain system 1600.

Figure 27:
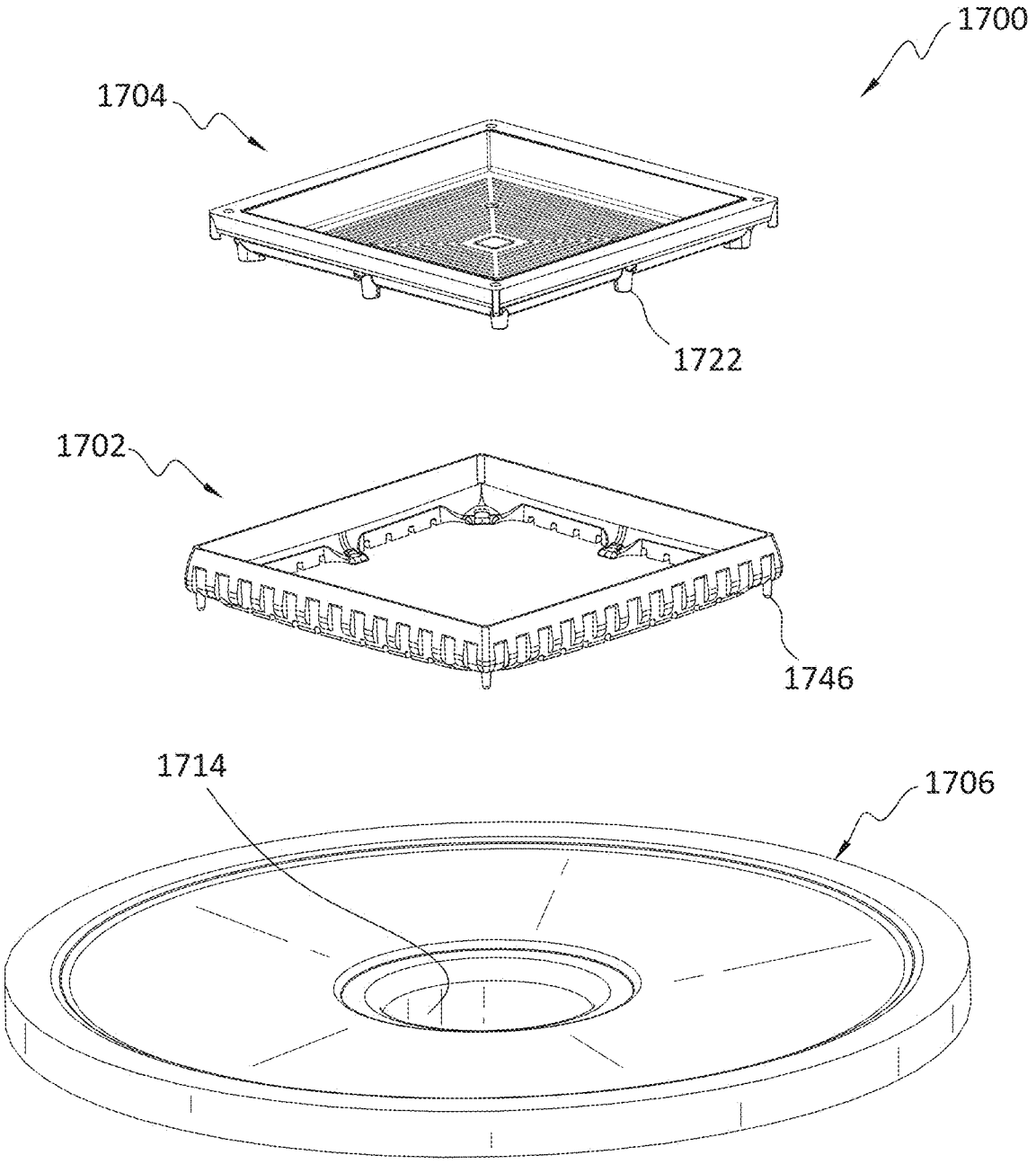
FIG. 27 is a perspective exploded view of a drain system according to another embodiment.

It will be appreciated that embodiments of the present disclosure can be sized and configured for use with tiles of different sizes and/or shapes. FIG. 27 shows yet another drain system 1700 having a greater height for use with thicker tiles according to an embodiment. The drain system 1700 can be similar to other embodiments of the present disclosure comprising a frame 1702 and the tray 1704 positionable over a drain opening 1714 of a drain body 1706. It will be appreciated the drain system 1700 can include any of the features described herein. For instance, the tray 1704 can include a plurality support members 1722 distributed about a bottom or underside of the tray 1704 and configured to interface with the frame 1702. The support members 1722 may be positioned and sized to define one or more fluid paths including a peripheral inlet between the tray 1704 and the frame 1702. In the illustrated embodiment, the drain system 1700 is shown without radial support extensions. The frame 1702 also defines a height configured so the drain system 1700 can be used with thicker tiles. For instance, the frame 1702 can define a height between a top surface and an underside of the frame of about ⅜ inches. This beneficially permits the drain system 1700 to be installed in a tile floor with tiles having a greater thickness. For instance, the drain system 1700 can be installed substantially flush with tiles having a thickness of about ⅜ inches.

Optionally, the frame 1702 can include one or more height adjustment features. For example, the frame 1702 can include one or more stand-offs 1746 comprising one or more posts configured to elevate the frame 1702 relative to an underlying surface. To lower the height of the frame 1702, the one or more posts can be removed or broken away from the underside or lower surface of the frame 1702. This beneficially can help adjust the height of the frame 1702 relative to one or more surrounding tiles or tile members. While four posts are shown, the frame 1702 can include any number of posts or any other form of stand-offs 1746. It will be appreciated that the height adjustment features of the present disclosure can be incorporated into any of the embodiments described herein.

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

The invention claimed is:

1. A drain system comprising:

a frame positionable over a drain opening of a drain body and being movable over the drain opening for at least lateral adjustment of the frame relative to the drain opening during installation, the frame comprising:

a wall portion;

a base portion extending radially inward from the wall portion, the base portion comprising a plurality of feet members spaced apart around the frame and defining a plurality of open spaces between the plurality of feet members;

a plurality of weep openings defined in the wall portion; and one or more radial support extensions extending radially outward from a bottom portion of the frame, wherein the plurality of weep openings are aligned with spaces defined between the one or more radial support extensions; and a tray removably positionable on the frame, the tray having a wall portion and comprising a plurality of support members distributed and spaced around an underside of the tray, the plurality of support members extending at least downwardly from the underside of the tray, wherein the plurality of support members are configured to interface with at least part of the frame such that a plurality of fluid paths are defined between the tray and the frame when the tray is positioned on the frame, at least some of the plurality of fluid paths extend around and under the tray and are in fluid communication with the drain opening.

2. The drain system of claim 1, wherein the tray having a varying cross-sectional thickness that is thinner toward a radial outer portion of the tray and increases from the radial outer portion toward a radial center of the tray to enhance drainage through the drain system.

3. The drain system of claim 1, wherein the plurality of fluid paths comprise a peripheral inlet defined around a periphery of the tray and below the underside of the tray.

4. The drain system of claim 3, wherein an area of the peripheral inlet is at least as great as an area of the drain opening.

5. The drain system of claim 1, wherein the wall portion of the frame includes a height defined between an underside of the frame and an upper surface of the frame and the upper surface includes a width defined between a radial outer surface of the wall portion of the frame and a radial inner surface of the wall portion of the frame, wherein a ratio between the width of the upper surface of the frame and a height of the wall portion of the frame is less than about 5% to help enhance a visual continuity of the drain system in a tile floor.

6. The drain system of claim 1, wherein the wall portion of the tray includes a height defined between the underside of the tray and an upper surface of the tray, the upper surface including a width defined between a radial outer surface of the wall portion of the tray and a radial inner surface of the wall portion of the tray, wherein a ratio between the width of the upper surface and the height of the wall portion of the tray is less than about 5% to help enhance a visual continuity of the drain system in a tile floor.

7. The drain system of claim 1, further comprising an obscuring finish located along an upper surface of the drain system to help enhance a visual continuity of the drain system in a tile floor.

8. The drain system of claim 7, wherein the obscuring finish comprises a black matte finish located along the upper surface on the wall portion of the tray.

9. The drain system of claim 7, wherein the obscuring finish comprises a black matte finish located along the upper surface on the wall portion of the frame.

10. The drain system of claim 1, wherein one or more of the plurality of feet members define a seat portion sized and configured to engage and position a bottom of at least one of the plurality of support members.

11. The drain system of claim 1, wherein the plurality of open spaces are sized and configured to improve fluid flow between the frame and the tray.

12. The drain system of claim 1, wherein a transition between the base portion and the wall portion comprises a curved surface.

13. A drain system comprising:

a frame positionable over a drain opening of a drain body and being movable over the drain opening for at least lateral adjustment of the frame relative to the drain opening during installation, the frame comprising:

a wall portion;

a base portion extending radially inward from the wall portion, the base portion comprising a plurality of feet members spaced apart around the frame and defining a plurality of open spaces between the plurality of feet members;

a plurality of weep openings defined in the wall portion; and one or more radial support extensions extending radially outward from a bottom portion of the frame, wherein the plurality of weep openings are aligned with spaces defined between the one or more radial support extensions.

14. A drain system comprising:

a frame positionable over a drain opening of a drain body and being movable over the drain opening for at least lateral adjustment of the frame relative to the drain opening during installation, the frame comprising:

a wall portion;

a base portion extending radially inward from the wall portion;

a plurality of weep openings defined in the wall portion; and one or more radial support extensions extending radially outward from a bottom portion of the frame, wherein the plurality of weep openings are aligned with spaces defined between the one or more radial support extensions.

15. The drain system of claim 14, further comprising a tray removably positionable on the frame, the tray having a wall portion and comprising a plurality of support members distributed and spaced around an underside of the tray, the plurality of support members extending at least downwardly from the underside of the tray, wherein the plurality of support members are configured to interface with at least part of the frame such that a plurality of fluid paths are defined between the tray and the frame when the tray is positioned on the frame, at least some of the plurality of fluid paths extend around and under the tray and are in fluid communication with the drain opening.

* * * * *